US008758065B2

(12) United States Patent
Fransen et al.

(10) Patent No.: US 8,758,065 B2
(45) Date of Patent: Jun. 24, 2014

(54) HIGH BANDWIDTH JACK WITH RJ45 BACKWARDS COMPATIBILITY

(71) Applicant: Panduit Corp., Tinley Park, IL (US)

(72) Inventors: Robert E. Fransen, Tinley Park, IL (US); Michael K. Yuan, Joliet, IL (US); Satish I. Patel, Roselle, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 13/677,941

(22) Filed: Nov. 15, 2012

(65) Prior Publication Data

US 2013/0122737 A1 May 16, 2013

Related U.S. Application Data

(60) Provisional application No. 61/560,430, filed on Nov. 16, 2011.

(51) Int. Cl.
*H01R 11/14* (2006.01)

(52) U.S. Cl.
USPC ..... 439/676; 439/217

(58) Field of Classification Search
USPC ..... 439/676, 389, 409, 76.1, 578–581, 439/540.1, 541.5, 324, 326, 620.21, 620.31, 439/404, 416, 426, 344, 941, 582, 629–631, 439/945, 105, 119, 236, 284; 361/728, 736, 361/740, 748
See application file for complete search history.

(56) References Cited

U.S. PATENT DOCUMENTS

| | | | | |
|---|---|---|---|---|
| 5,971,812 | A * | 10/1999 | Martin | 439/676 |
| 6,176,743 | B1 | 1/2001 | Kuo | |
| 6,776,658 | B2 * | 8/2004 | Tang | 439/607.58 |
| 6,913,492 | B2 * | 7/2005 | Kuroda et al. | 439/631 |
| 6,926,559 | B1 * | 8/2005 | Hung et al. | 439/630 |
| 6,932,652 | B1 * | 8/2005 | Chen | 439/630 |
| 7,033,219 | B2 * | 4/2006 | Gordon et al. | 439/607.41 |
| 7,160,135 | B1 * | 1/2007 | Wu | 439/352 |
| 7,540,760 | B1 | 6/2009 | Chen | |
| 7,731,538 | B2 * | 6/2010 | Kiryu et al. | 439/630 |
| 7,803,010 | B1 * | 9/2010 | Hwang | 439/497 |
| 2005/0136747 | A1 | 6/2005 | Caveney et al. | |
| 2007/0082509 | A1 | 4/2007 | Kuo | |
| 2010/0203751 | A1 | 8/2010 | Tsai | |
| 2011/0028024 | A1 | 2/2011 | Lu | |
| 2011/0059645 | A1 * | 3/2011 | Wu | 439/460 |
| 2012/0052744 | A1 * | 3/2012 | Straka et al. | 439/676 |

FOREIGN PATENT DOCUMENTS

| | | | |
|---|---|---|---|
| TW | M414006 | U | 10/2011 |
| WO | 2009058234 | A1 | 5/2009 |

* cited by examiner

*Primary Examiner* — Renee S Luebke
*Assistant Examiner* — Harshad Patel
(74) *Attorney, Agent, or Firm* — Christopher S. Clancy; Yuri Astvatsaturov

(57) ABSTRACT

The present invention generally relates to network connectors, and more particularly, to apparatuses, systems, and methods associated with network jacks having compatibility with more than one plug and corresponding plugs. In one embodiment, the present invention is a jack having multiple printed circuit boards, wherein each circuit board is used for connection to a particular style of a plug. In one embodiment, the jack according to the present invention is compatible with an RJ45 plug.

20 Claims, 24 Drawing Sheets

HIGH BANDWIDTH JACK WITH RJ45 BACKWARDS COMPATIBILITY

CROSS-REFERENCE TO RELATED APPLICATIONS

This application claims the benefit of U.S. Provisional Patent Application No. 61/560,430, filed on Nov. 16, 2011.

FIELD OF INVENTION

The present invention generally relates to network connectors, and more particularly, to apparatuses, systems, and methods associated with network jacks having compatibility with more than one plug and corresponding plugs.

BACKGROUND

With a steady increase of users adopting 10GBASE-T Ethernet for platforms such as high performance computing (HPC), storage area networks (SANs), and cloud computing, there is a need for an increase in bandwidth in the network backbone to support such increasing data transfer rates. The structured cabling industry has recently started a dialogue regarding the feasibility of next-generation high-bandwidth cabling solutions to anticipate the next computing boom.

Among the top currently established data transmission rates for structured copper cabling is 10 Gigabits per second running on Augmented Category 6 (CAT6A) cabling. Additionally, point-to-point copper cabling solutions can run through a 40 Gigabits per second Quad Small Form-factor Pluggable (QSFP) connector via a twin-axial copper cable. Unfortunately, the QSFP connectivity comes with drawbacks such as deficiencies in maximum length and a potential lack of backwards compatibility with other connector styles.

It is desirable to create a connector that is capable of reaching the higher bandwidth requirement of emerging platforms while still providing backwards compatibility with an RJ45 plug.

SUMMARY

Accordingly, the present invention is directed to apparatuses, systems, and methods associated with network connectors having backwards compatibility.

In one embodiment, the present invention is a communication connector comprising a housing defining a cavity for receiving a communication plug, a first printed circuit board (PCB) positioned at least partially within the housing and having a plurality of plug interface contacts (PICs) extending therefrom for making contact with a plurality of plug contacts of a first type of a plug, a second PCB positioned at least partially within the housing and having a plurality of contact pads for making contact with a plurality of plug contacts of a second type of a plug, and a plurality of insulation displacement contacts (IDCs) contacting the second PCB.

The connector can further have the housing including at least one generally vertical wall feature with the second PCB being positioned generally horizontally with respect to the at least one generally vertical wall feature. The at least one generally vertical wall feature and the second PCB define four quadrants, and the plurality of IDCs include four pairs of IDCs, where each of the pairs of IDCs is positioned within each of the quadrants, respectively.

In yet another embodiment, the present invention is a communication connector comprising a housing defining a cavity for receiving a communication plug where the housing includes at least one generally vertical wall feature, a first PCB positioned at least partially within the housing and used for making electrical contact with a first type of a plug, a second PCB positioned at least partially within the housing and used for making electrical contact with a second type of a plug. The second PCB is positioned generally horizontally with respect to the at least one generally vertical wall feature, where the at least one generally vertical wall feature and the second PCB define four housing quadrants, each of the housing quadrants being at least partially electrically shielded from any other housing quadrant. The connector further includes a plurality of IDCs contacting the second PCB where the plurality of IDCs are arranged in multiple pairs, and each of the multiple pairs is positioned in a respective housing quadrant.

The connector can further include a wire cap attached at a rear end of the housing, the wire cap including an isolation component, the isolation component defining four isolation component quadrants, each of the isolation component quadrants being at least partially electrically shielded from any other isolation component quadrant, wherein the wire cap and the housing alight such that the four housing quadrants align with the four isolation component quadrants.

In still yet another embodiment, the present invention is a communication connector for terminating to a braided communication cable, where the connector includes a metal housing, a metal front face positioned as a front end of the metal housing, at least one plug grounding tab in electrical contact with the metal front face, a wire cap positioned at a rear end of the metal housing, and at least one latch arm, where the at least one latch arm includes a bonding contact. The bonding contact fits at least partially over the wire cap and is in electrical contact with the metal housing and a braid of the braided communication cable.

These and other features, aspects, and advantages of the present invention will become better understood with reference to the following drawings, description, and any claims that may follow.

DETAILED DESCRIPTION

In one embodiment, the present invention is a network jack capable of supporting two different modes of operation depending on the type of plug that is inserted. In this embodiment, the jack can be mated with an RJ45 plug, using plug interface-type contacts in the jack, for network speeds up to 10GBASE-T; and the same jack can be mated with a plug having a form factor similar to an RJ45 plug but using card edge terminals in the jack, for higher speed applications (e.g., 40GBASE-T).

Figure 1:
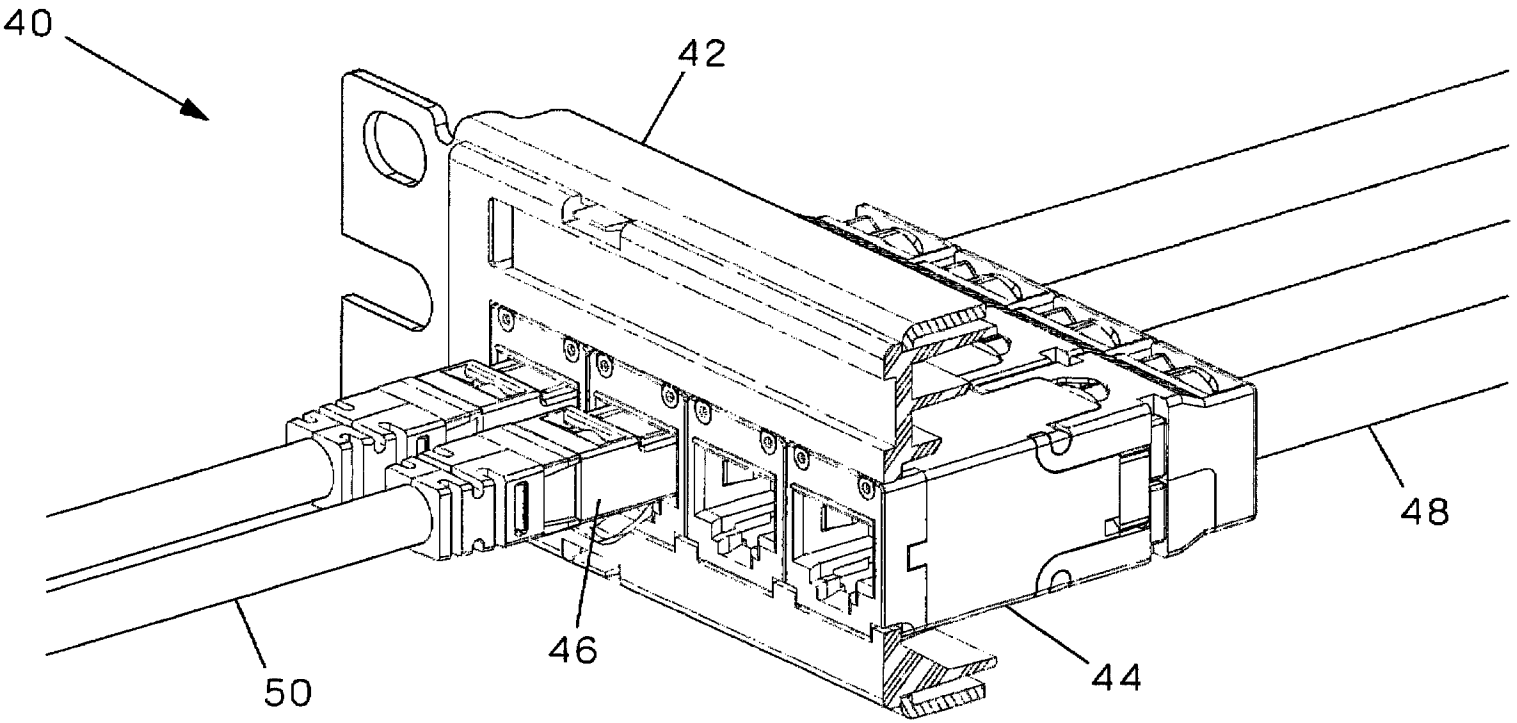
FIG. 1 shows a front isometric view of a communication system according to an embodiment of the present invention.

An exemplary embodiment of the present invention is illustrated in FIG. 1, which shows a copper structured cabling communication system 40, which includes a patch panel 42 with jacks 44 and corresponding RJ45 plugs 46. Respective cables 48 are terminated to jacks 44, and respective cables 50 are terminated to plugs 46. Once a plug 46 mates with a jack 44 data can flow in both directions through these connectors. Although the communication system 40 is illustrated in FIG. 1 as having a patch panel, alternative embodiments can include other active or passive equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers and or telecommunications rooms; security devices (cameras and other sensors, etc.) and door access equipment; and telephones, computers, fax machines, printers, and other peripherals as can be found in workstation areas. Communication system 40 can further include cabinets, racks, cable management and overhead routing systems, and other such equipment.

Figure 2:
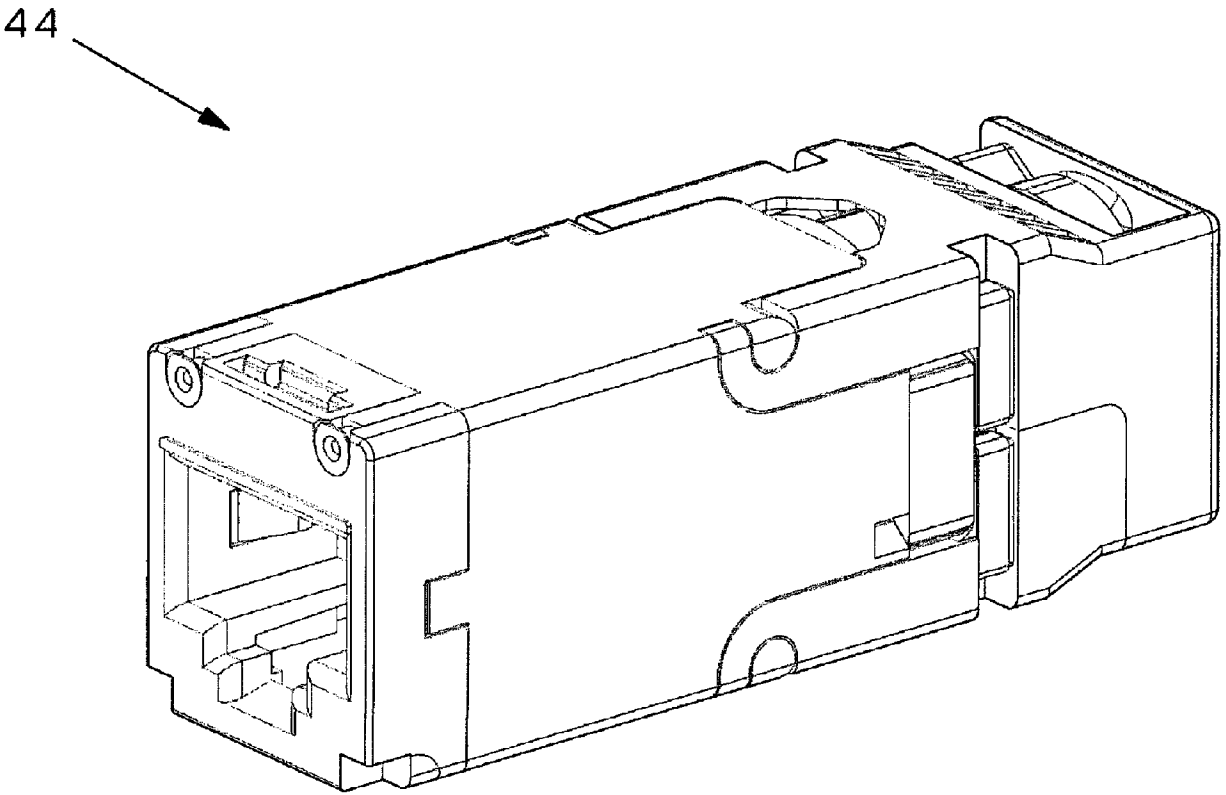
FIG. 2 shows a front isometric view of a jack according to an embodiment of the present invention.
Figure 3:
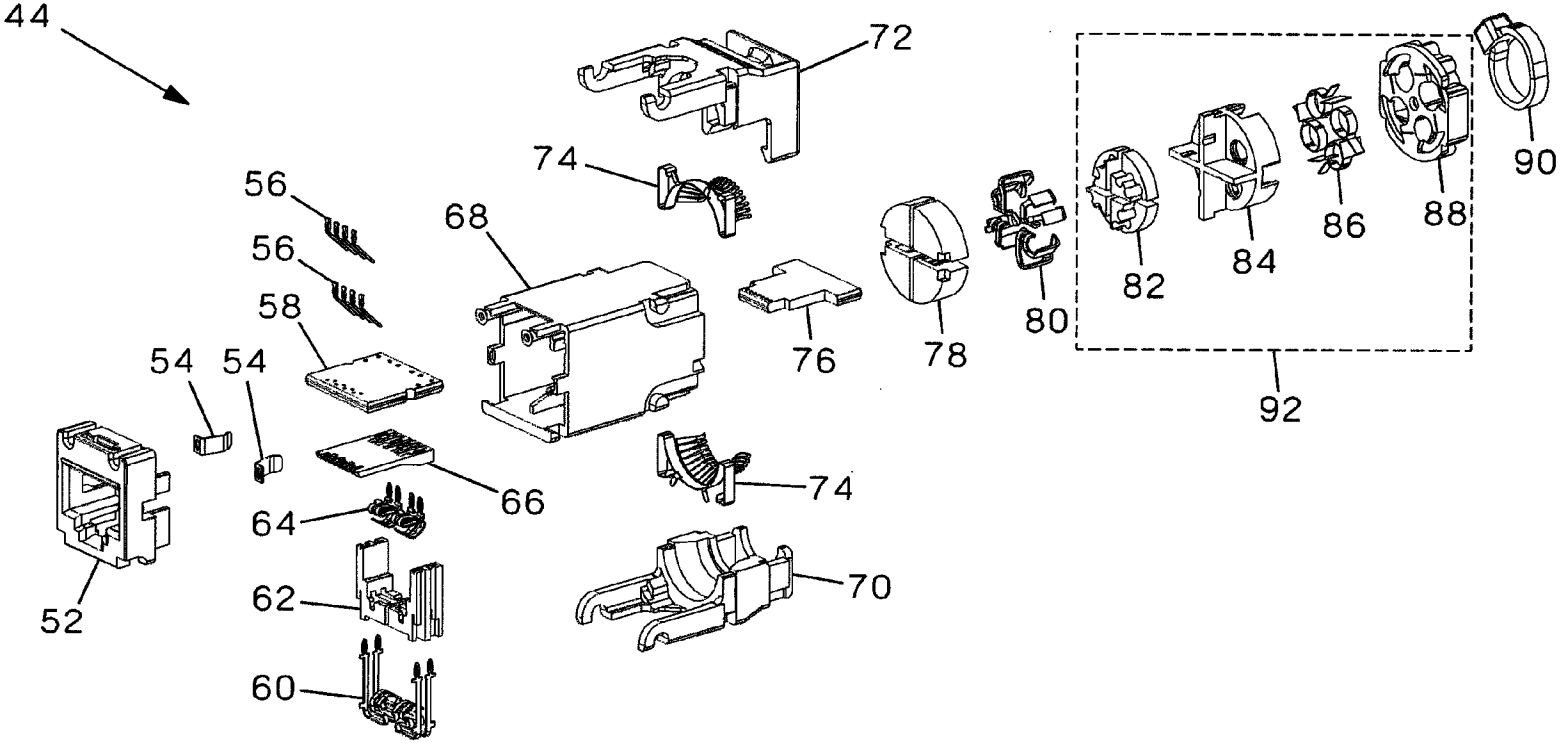
FIG. 3 shows an exploded isometric view of a jack according to an embodiment of the present invention.

Referring now to FIG. 2, in one embodiment, jack 44 complies with Mini-Com® geometry as employed by Panduit Corp., and installs to Mini-Com® patch panels and faceplates. FIG. 3 shows an exploded view of an embodiment of jack 44. In one embodiment, jack 44 includes a metal front face 52 and plug grounding tabs 54 which can be used to electrically bond a shielded plug to jack 44. Plug interface contacts (PICs) 56 are used to engage the contacts of an RJ45 plug and carry electrical signals to a first printed circuit board (PCB) 58. PICs 56 may be thin-layered contacts like those described in U.S. Patent Application Publication No. 2012/0244752, entitled "COMMUNICATION CONNECTOR," filed on Mar. 20, 2012, and incorporated herein by reference in its entirety. In some embodiments, the first PCB 58 can include compensation components which can serve to reduce at least some amount of crosstalk that may arise in an RJ45 plug and/or in the PICs 56. Four tall PCB-to-PCB contacts 60 carry electrical signals from the first PCB 58 to the main PCB 76. Two tall PCB-to-PCB contact plastic support structures 62 are used to constrain the tall PCB-to-PCB contacts 60. Four short PCB-to-PCB contacts 64 also carry electrical signals from the first PCB 58 to the main PCB 76. A plastic contact support structure 66 constrains short PCB-to-PCB contacts 64 and provides bend radius control for PICs 56. Housing 68 holds at least some of the internal components of jack 44 and may be made of metal to provide shielding and bonding to a shielded patch panel, which can help to achieve the required electrical performance at certain high frequencies. Lower latch arm 70 and upper latch arm 72 snap together during the cable termination process and form the back section of jack 44. A braid bonding contact 74 is assembled to each lower latch arm 70 and upper latch arm 72. Insulation displacement contacts (IDCs) 80 electrically bond the conductors of a terminated cable to main PCB 76. Four plastic IDC support structures 78 constrain IDCs 80. Wire cap 92 includes plastic conductor alignment structures 82, metal isolation component 84, foil grounding springs 86, and a metal wire cap nut 88. A cable tie 90 can be used to provide strain relief for the terminated cable.

Figure 4:
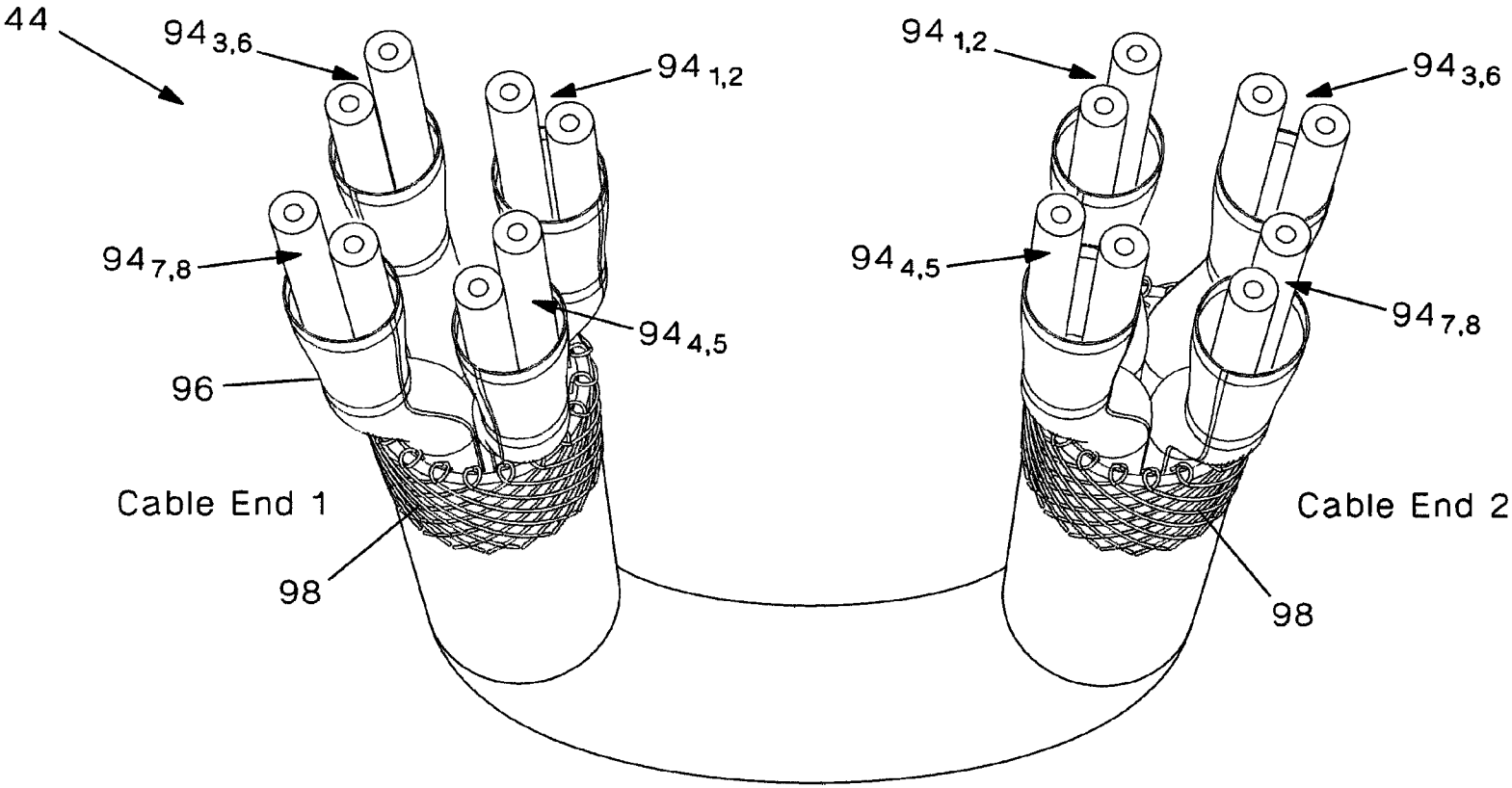
FIG. 4 shows a communication cable for use with connectors according to some embodiments of the present invention.

In one embodiment, jack 44 is designed to work with shielded/foiled twisted wire pair cable, as shown in FIG. 4, where each wire pair 94 has its own foil wrap 96 and there exists an overall braid 98 around all four wire pairs. This will be referred to as an S/FTP cable 48. A twisted wire pair cable, by the nature of its design, has four wire pairs 94 in different orientations at each end. Referring to FIG. 4, cable end 1 has a clockwise wire orientation $\mathbf{94}_{1,2}$, $\mathbf{94}_{4,5}$, $\mathbf{94}_{7,8}$, $\mathbf{94}_{3,6}$. However, cable end 2 has a mirror clockwise wire orientation $\mathbf{94}_{1,2}$, $\mathbf{94}_{3,6}$, $\mathbf{94}_{7,8}$, $\mathbf{94}_{4,5}$. The subscript numbers of each wire pair 94 can represent RJ45 pin positions as defined by ANSI/TIA-568-C.2. Jack 44 is designed to accommodate the termination of either end of the communication cable 48.

Figure 5B:
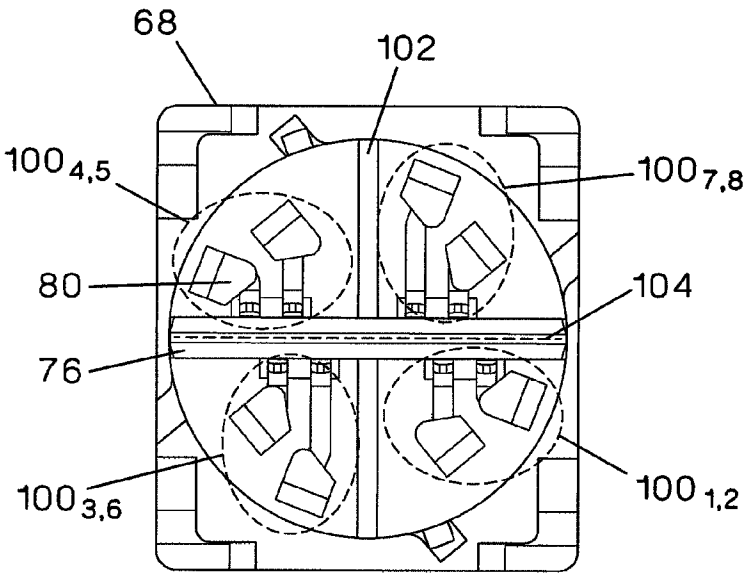
FIG. 5B shows a rear cross-sectional view of the jack of FIG. 5A.
Figure 5A:
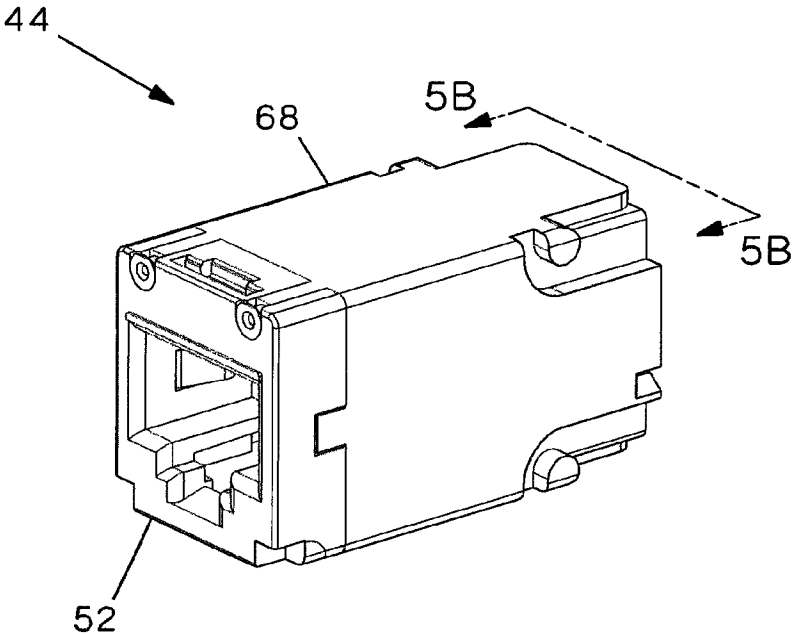
FIG. 5A shows a front isometric view of a partially assembled jack according to an embodiment of the present invention.

Turning to the next figures, FIG. 5A shows a partially assembled jack 44 with latch arms 70 and 72, and wire cap 92 removed. The rear view of the partially assembled jack 44 is visible in FIG. 5B which shows IDCs 80 and the respective IDC pairs $\mathbf{100}_{1,2}$, $\mathbf{100}_{3,6}$, $\mathbf{100}_{4,5}$, and $\mathbf{100}_{7,8}$. The subscript numbers of each IDC pair 100 can correspond to each wire pair 94 of the S/FTP cable 48, respectively. The back of the housing 68 is divided into four quadrants by main PCB 76 and wall features 102. Main PCB 76 includes a ground plane 104 that spans the entire center plane of the circuit board. In the presently described embodiment, the wall features 102 are a design element of the housing 68 and can be metal. Such a layout results in each IDC pair 100 being located within one quadrant, and each quadrant being shielded from any other quadrant. Such shielding can block at least some crosstalk effects from one IDC pair 100 to another IDC pair 100. For example, the crosstalk between IDC pair $\mathbf{100}_{4,5}$ and IDC pair $\mathbf{100}_{7,8}$ may be reduced because of metal wall feature 102. Similarly crosstalk between IDC pair $\mathbf{100}_{4,5}$ and IDC pair $\mathbf{100}_{3,6}$ may also be reduced because of ground plane 104.

Figure 6:
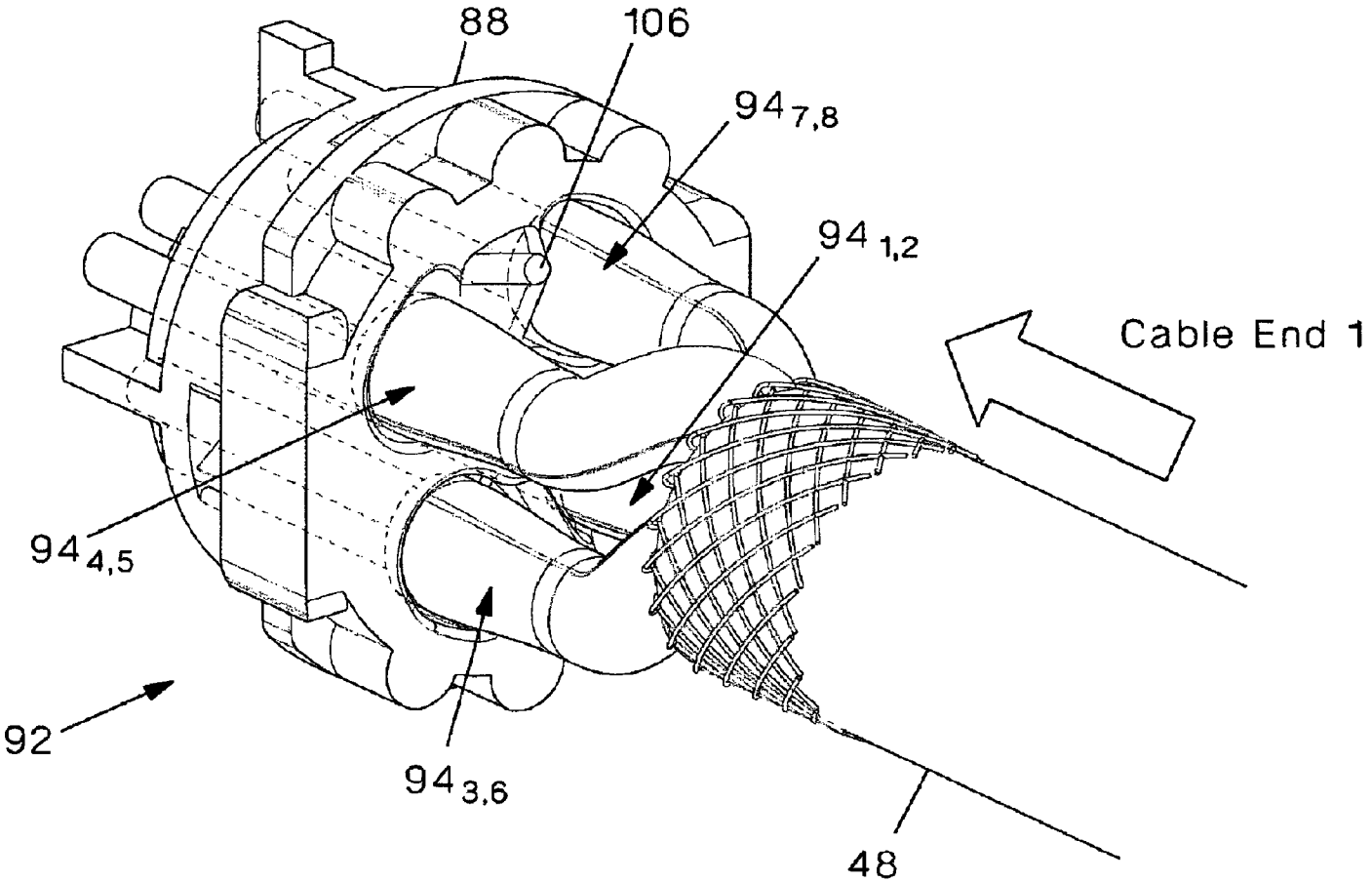
FIG. 6 shows end 1 of the communication cable of FIG. 4 oriented for termination to a wire cap according to an embodiment of the present invention.

To terminate cable end 1 of S/FTP cable 48, wire pairs 94 ($\mathbf{94}_{1,2}$, $\mathbf{94}_{3,6}$, $\mathbf{94}_{4,5}$, and $\mathbf{94}_{7,8}$) are oriented as shown in FIG. 6 and inserted into wire cap 92. Wire pair $\mathbf{94}_{4,5}$ and wire pair $\mathbf{94}_{7,8}$ cross each other prior to insertion into wire cap 92. These two crossed wire pairs insert over a guiding feature. In the current embodiment, the guiding feature is a protrusion feature 106, which can be a pyramidal feature on wire cap nut 88. Protrusion feature 106 can be used as a visual indicator for the installer to denote where to insert the two crossed wire pairs as well as to provide a lead-in and routing control for the crossed wire pairs.

Figure 7:
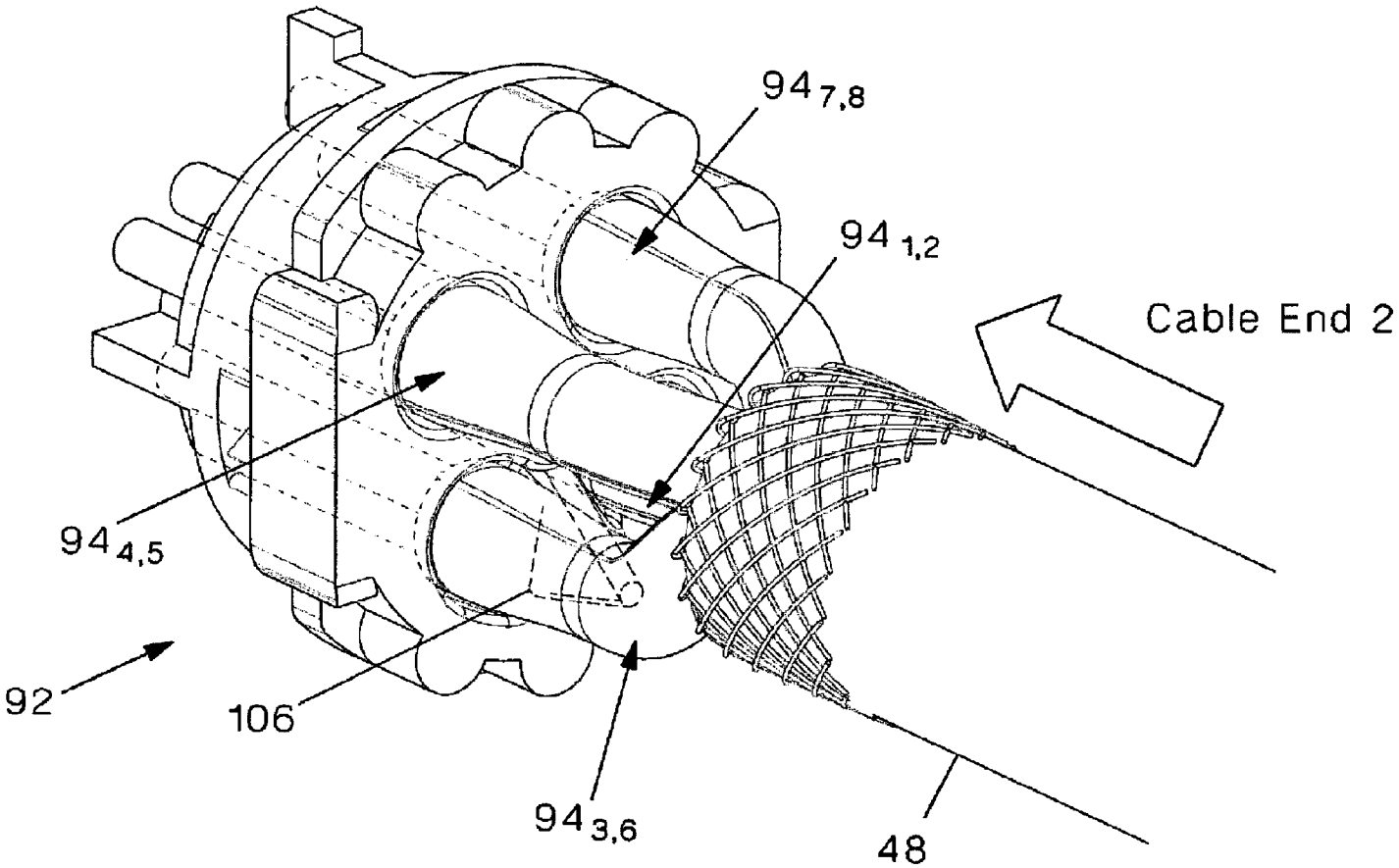
FIG. 7 shows end 2 of the communication cable of FIG. 4 oriented for termination to a wire cap according to an embodiment of the present invention.

To terminate cable end 2 of S/FTP cable 48, wire pairs 94 ($\mathbf{94}_{1,2}$, $\mathbf{94}_{3,6}$, $\mathbf{94}_{4,5}$, and $\mathbf{94}_{7,8}$) are oriented as shown in FIG. 7 and inserted into wire cap 92. Note that wire cap 92 is rotated 180° about central axis of S/FTP cable 48 such that protrusion feature 106 is at the bottom of the view. Wire pair $\mathbf{94}_{1,2}$ and wire pair $\mathbf{94}_{3,6}$ cross each other prior to insertion into wire cap 92. Similar to cable end 1, these two crossed pairs are inserted over protrusion feature 106.

Figure 8:
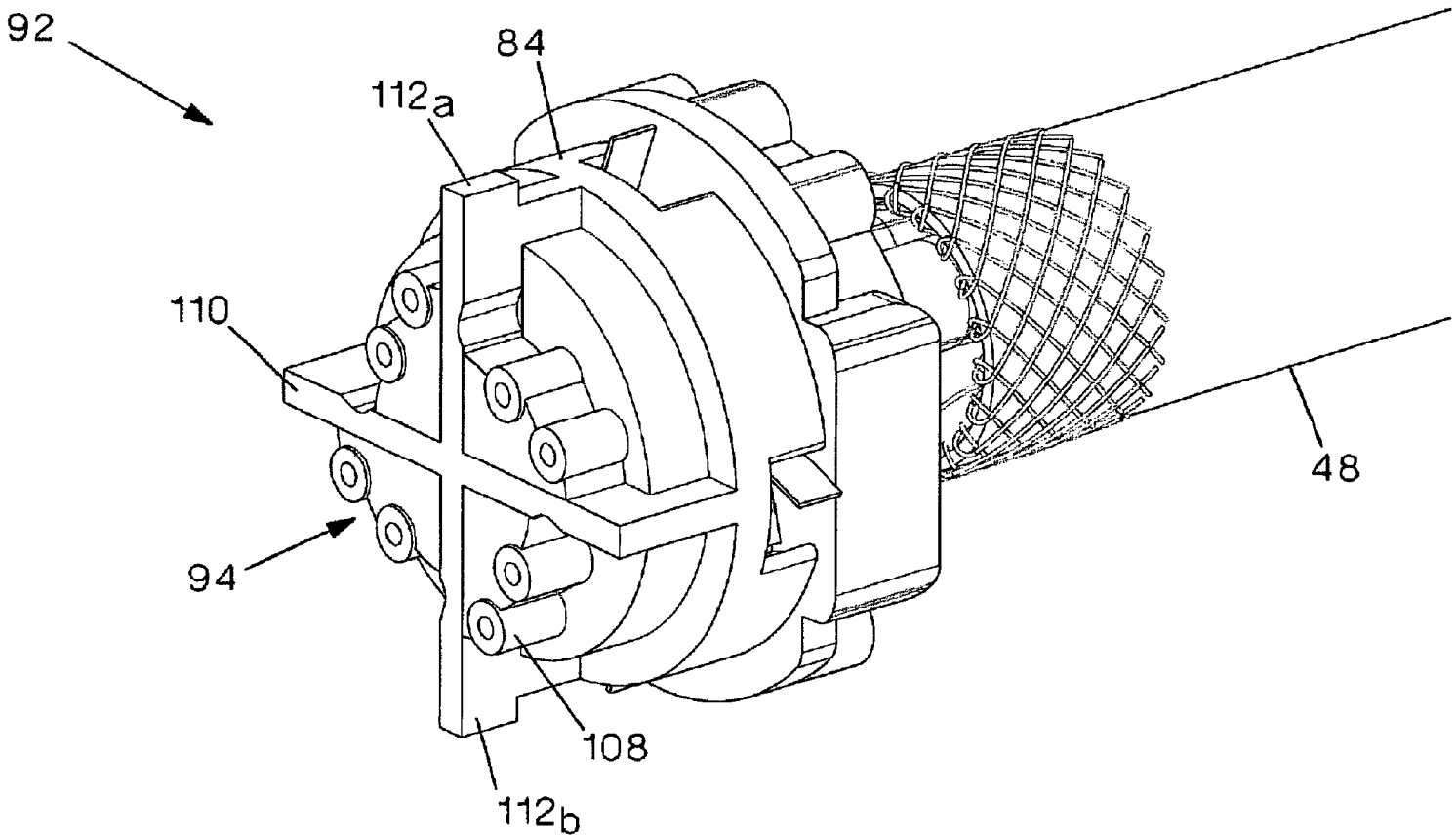
FIG. 8 shows a front isometric view of a communication cable being terminated to a wire cap according to an embodiment of the present invention.

After all wire pairs 94 of S/FTP cable 48 are fully inserted into wire cap 92, wires 108 are trimmed relatively flush to face 110 of isolation component 84, as shown in FIG. 8. The trimming of the wires 108 is performed at both ends of the S/FTP cable. Note that each wire pair 94 resides within its own quadrant, where each quadrant can be shielded from any other quadrant. Since in some embodiments isolation component 84 can be metal or can include other shielding materials, crosstalk effects from one conductor pair 94 to any other conductor pair 94 may be reduced.

Figure 9:
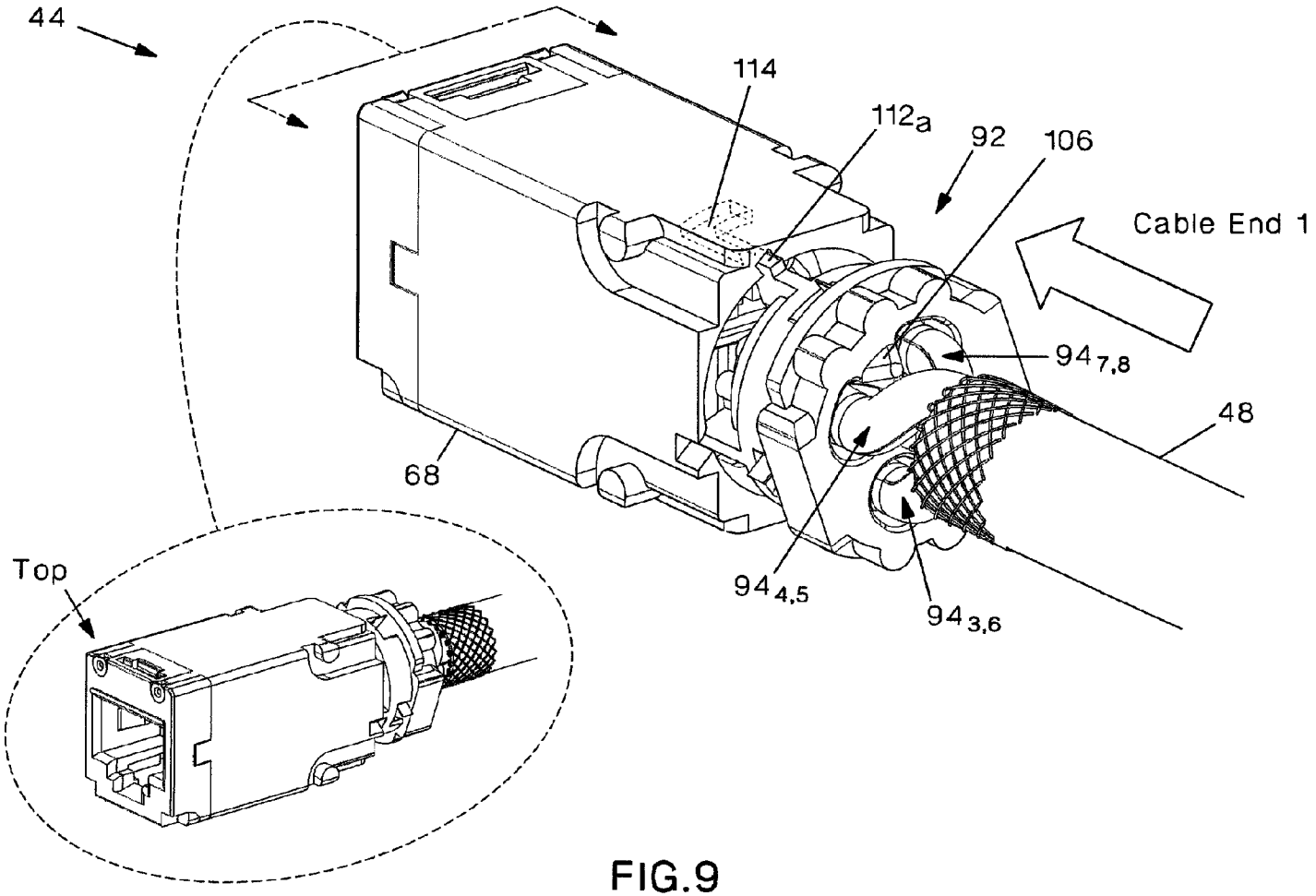
FIG. 9 shows a rear isometric view of a wire cap with end 1 of the communication cable of FIG. 4 being assembled to a partially assembled jack according to an embodiment of the present invention.
Figure 10:
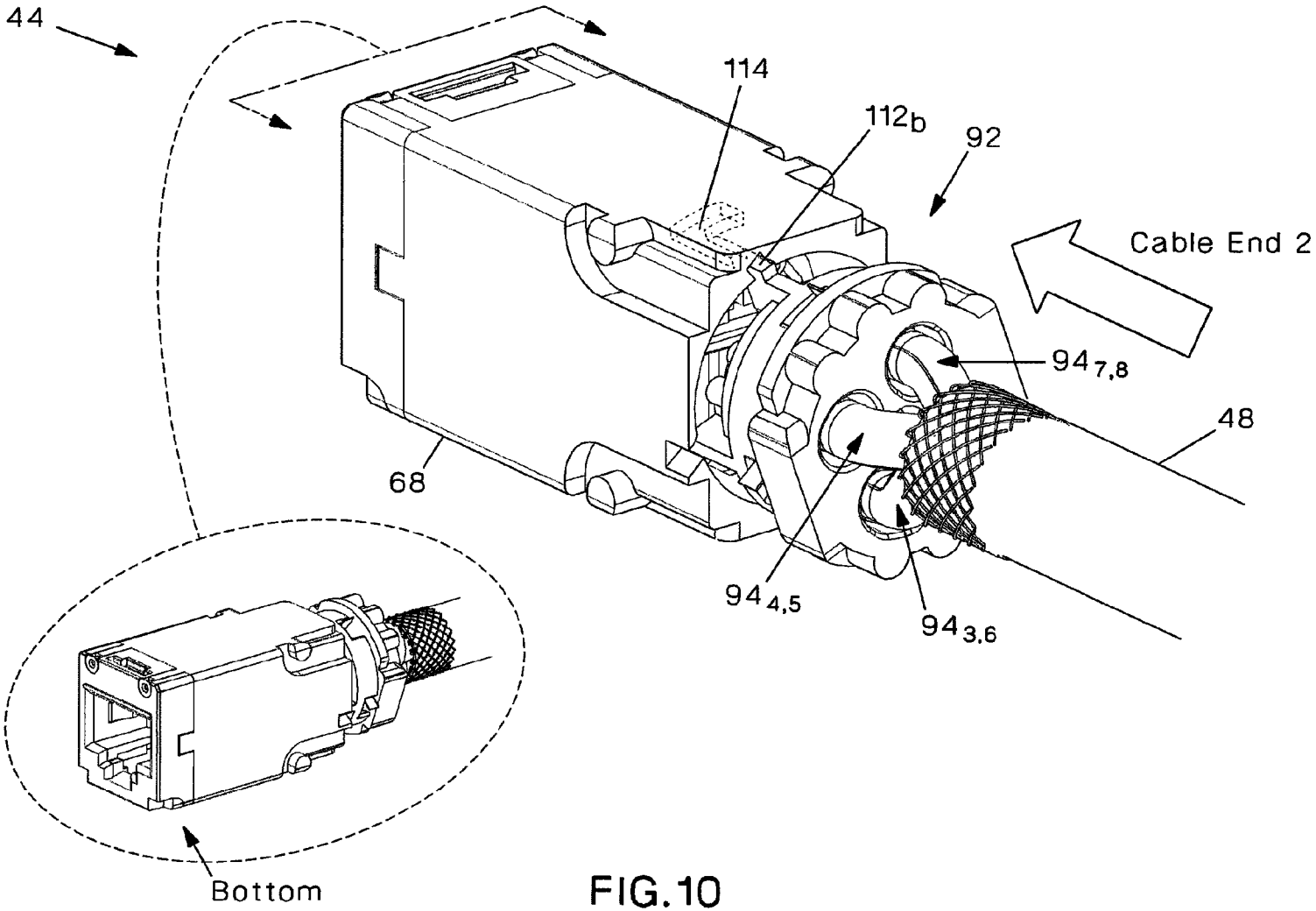
FIG. 10 shows a rear isometric view of a wire cap with end 2 of the communication cable of FIG. 4 being assembled to a partially assembled jack according to an embodiment of the present invention.

After wires 108 are trimmed relatively flush to face 110, wire cap 92 and S/FTP cable 48 are inserted into the back of the housing 68. If cable end 1 is being terminated, the two crossed wire pairs $\mathbf{94}_{4,5}$ and $\mathbf{94}_{7,8}$, and protrusion feature 106 are generally at the top relative to the jack 44 orientation shown in FIG. 9. In the currently described embodiment, proper alignment of wire cap 92 is assisted by tab $\mathbf{112}_a$, located on isolation component 84, slotting into slot 114, located in the housing 68. If cable end 2 is being terminated, the two crossed wire pairs $\mathbf{94}_{1,2}$ and $\mathbf{94}_{3,6}$, and protrusion feature 106 are generally at the bottom relative to the jack 44 orientation shown in FIG. 10. Similarly to cable end 1, proper alignment of wire cap 92 is assisted by tab $\mathbf{112}_b$ located on isolation component 84 slotting into slot 114.

Figure 11B:
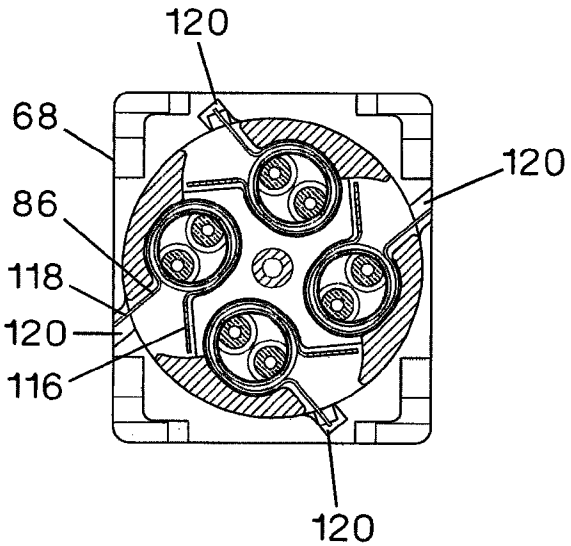
FIG. 11B shows a rear cross-sectional view of the jack of FIG. 11A.
Figure 11A:
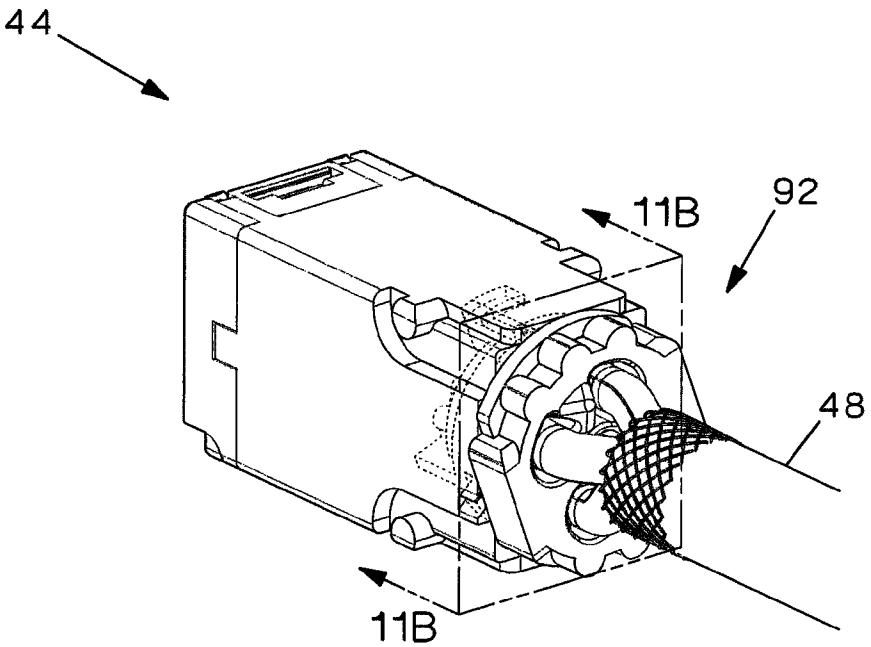
FIG. 11A shows a rear isometric view of a partially assembled jack according to an embodiment of the present invention.
Figure 12B:
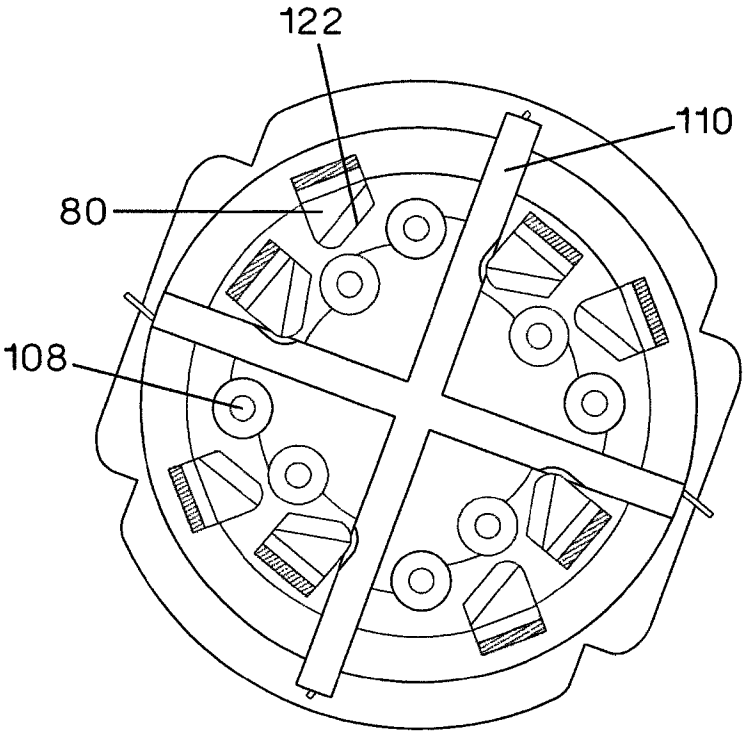
FIG. 12B shows a front cross-sectional view of the wire cap of FIG. 12A.
Figure 12A:
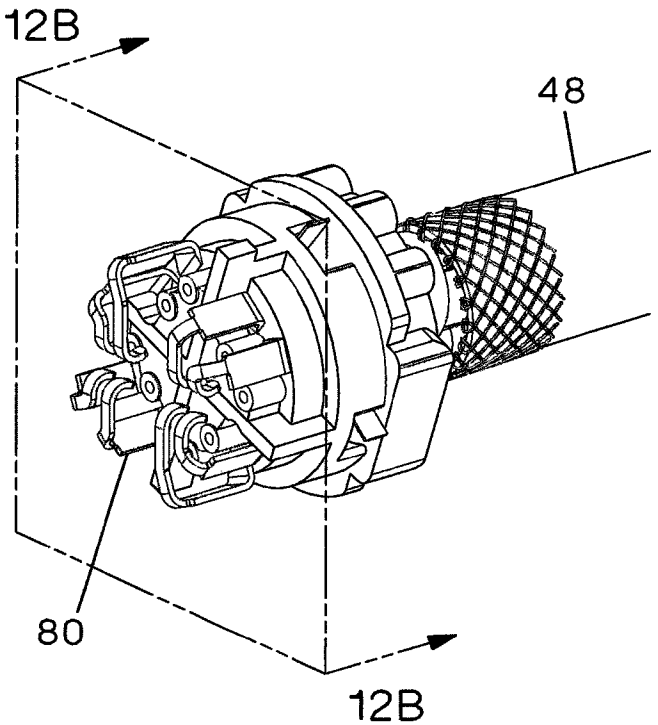
FIG. 12A shows a front isometric view of a wire cap and insulation displacement contacts (IDCs) disengaged from a communication cable according to an embodiment of the present invention.

The remainder of the termination process is generally the same regardless of whether cable end 1 or cable end 2 is being terminated. As shown in FIG. 11A, wire cap 92 and S/FTP cable 48 are pushed forward into the housing 68 of jack 44 until a positive stop is made. The positive stop can be considered to be made when face 110 of isolation component 84 contacts main PCB 76 and wall feature 102 of housing 68. As shown in FIG. 11B, foil grounding springs 86 have fixed ends 116 and free ends 118. Fixed ends 116 are locked between and electrically bonded to isolation component 84 and wire cap nut 88. During insertion of wire cap 92 into the housing 68, free ends 118 of foil grounding springs 86 reside within clearance pockets 120 of housing 68. FIG. 12A shows a front isometric view of FIG. 11A with all internal housing components (with the exception of the IDCs 80) removed for clarity. This view illustrates IDCs 80 prior to engaging wires 108. Clearance exists between wires 108 and IDCs 80, as shown in the section view of FIG. 12B, such that wire cap 92 can be inserted without restriction.

Figure 13B:
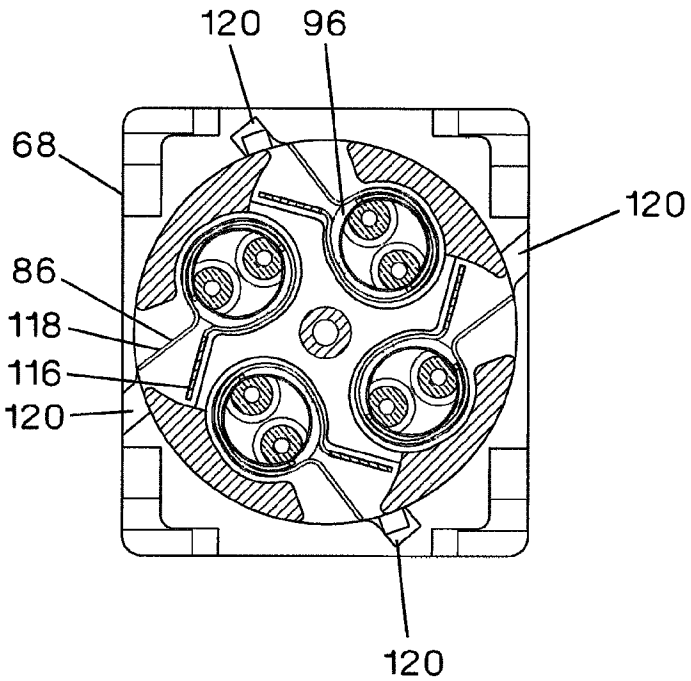
FIG. 13B shows a rear cross-sectional view of the wire cap of FIG. 13A.
Figure 13A:
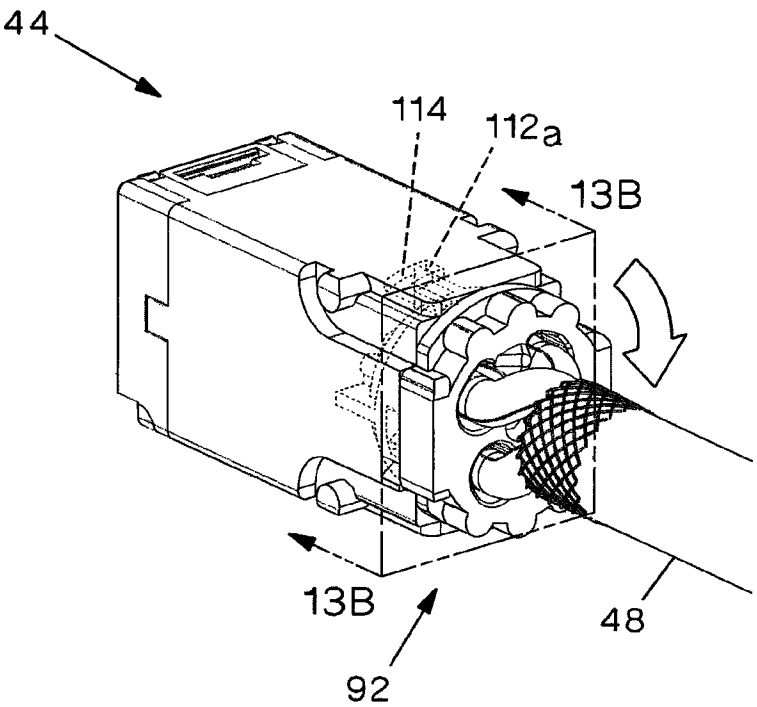
FIG. 13A shows a rear isometric view of the engagement of a wire cap with a partially assembled jack according to an embodiment of the present invention.

After wire cap 92 and S/FTP cable 48 are fully inserted into the housing 68, wire cap 92 is rotated approximately 20° clockwise, as shown in FIG. 13A. In the embodiment being described, the wire cap 92 cannot be rotated unless it is fully inserted because tabs $\mathbf{112}_a$ and $\mathbf{112}_b$ are constrained inside of slot 114. The action of rotating the wire cap 92 causes free ends 118 of the foil grounding springs 86 to interfere with housing 68, as shown in FIG. 13B. This results in a collapse of grounding springs 86 around foil wraps 96 of wire pairs 94, causing an electrical bond between foil grounding springs 86 and foil wraps 96. This relationship generally bonds foil wraps 96 to metallic components of wire cap 92. This ensures that the electrical bond between foil wraps 96 of wire pairs 94 are generally at equal potential, which helps maintain electrical balance between wire pairs 94 and can result in improved noise immunity from outside sources.

Figure 14B:
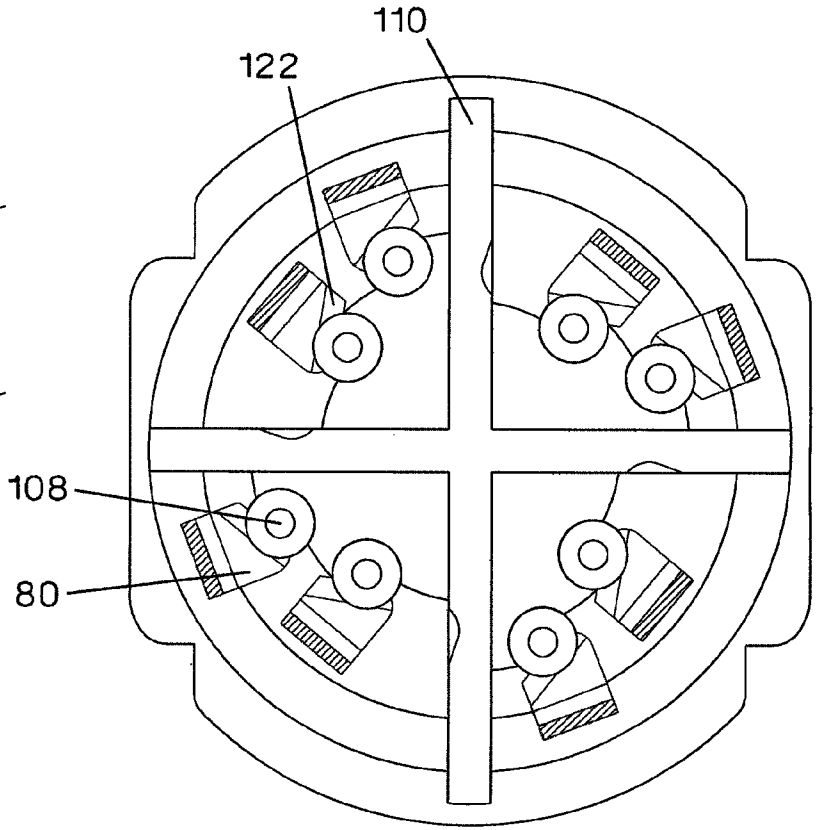
FIG. 14B shows a front cross-sectional view of the wire cap of FIG. 14A.
Figure 14A:
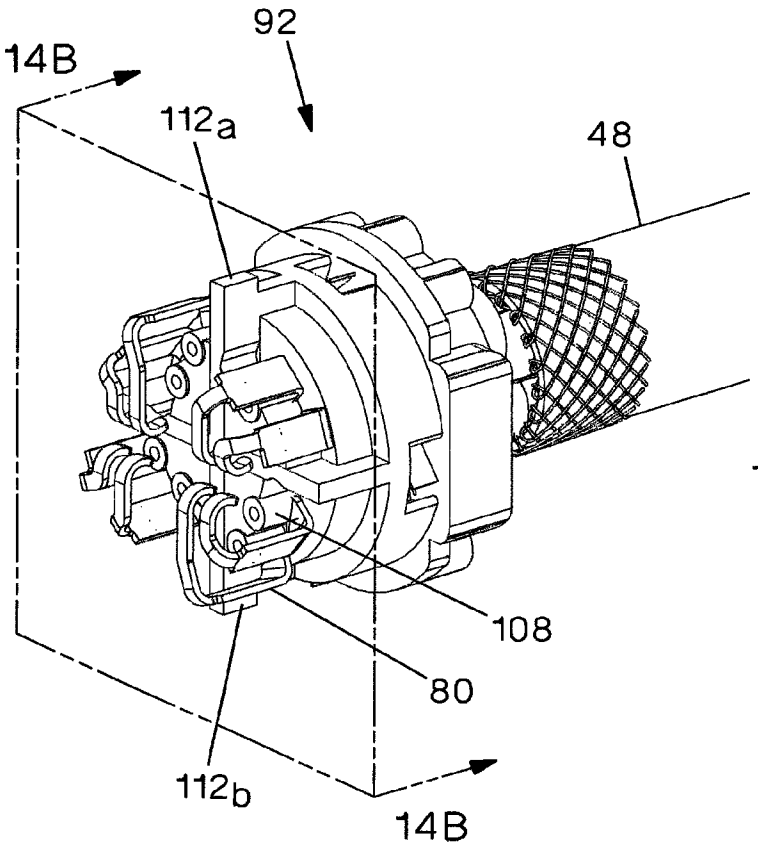
FIG. 14A shows a front isometric view of a wire cap and IDCs engaged with a communication cable according to an embodiment of the present invention.

As seen in FIGS. 14A and 14B, the action of rotating wire cap 92 by approximately 20° also causes wires 108 to rotate into and engage the cutting edges 122 of IDCs 80. This results in an electrical connection between IDCs 80 and metal conductors within wires 108. Additionally, when wire cap 92 is rotated fully into position, face 110 of isolation component 84 mates and aligns with wall feature 102 of housing 68 and ground plane 104 of main PCB 76 (reference FIG. 5). This results in each isolated IDC quadrant in the rear section of jack 44 aligning with the respective wire quadrant within wire cap 92, resulting in a shielded system that may reduce crosstalk effects between one IDC pair 100 and wire pair 94, and any other IDC pair 100 and wire pair 94.

Figure 15B:
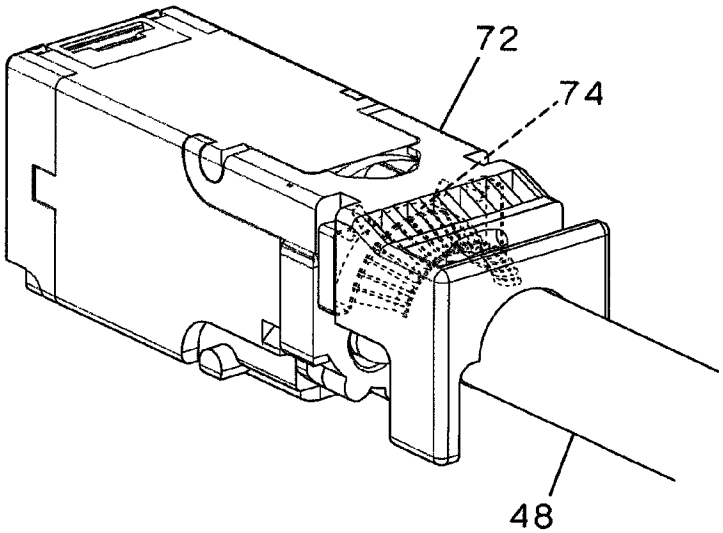
FIG. 15B shows a rear isometric view of a partially assembled jack with an upper latching arm in a downward closed position according to an embodiment of the present invention.
Figure 15A:
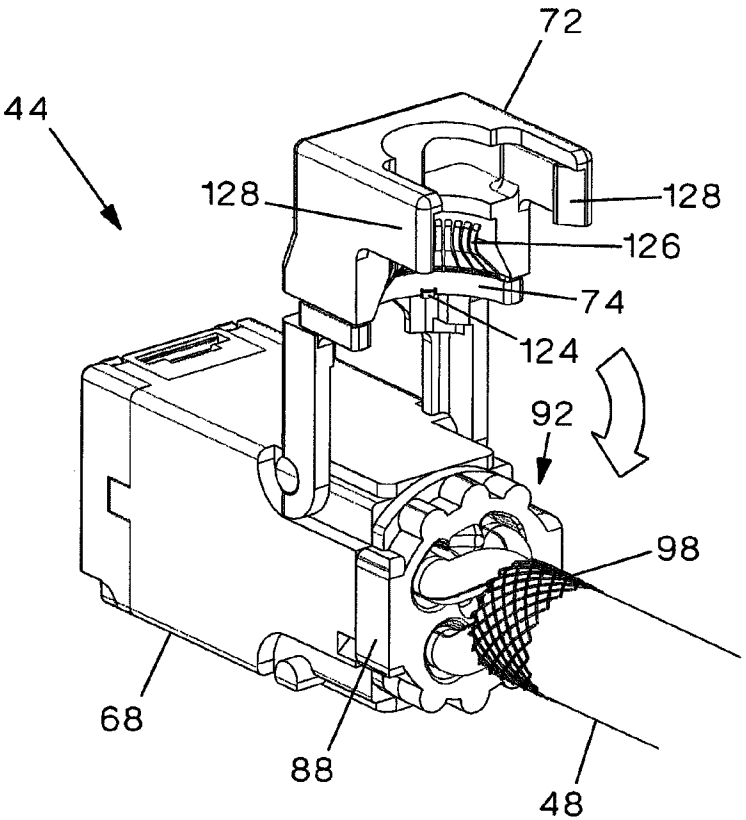
FIG. 15A shows a rear isometric view of a partially assembled jack with an upper latching arm in an open position according to an embodiment of the present invention.
Figure 16:
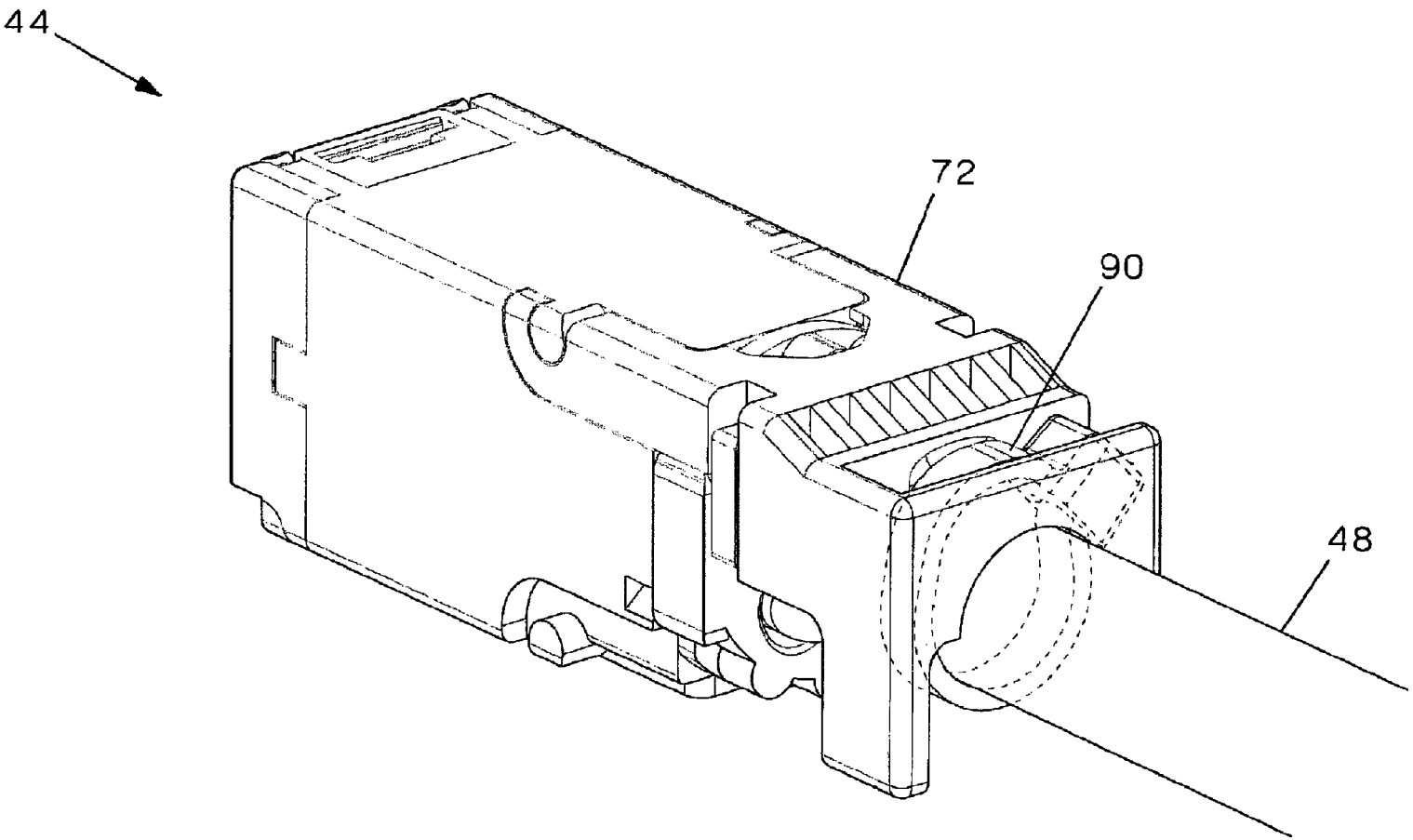
FIG. 16 shows a rear isometric view of a partially assembled jack attached to a communication cable via a cable tie according to an embodiment of the present invention.
Figure 17:
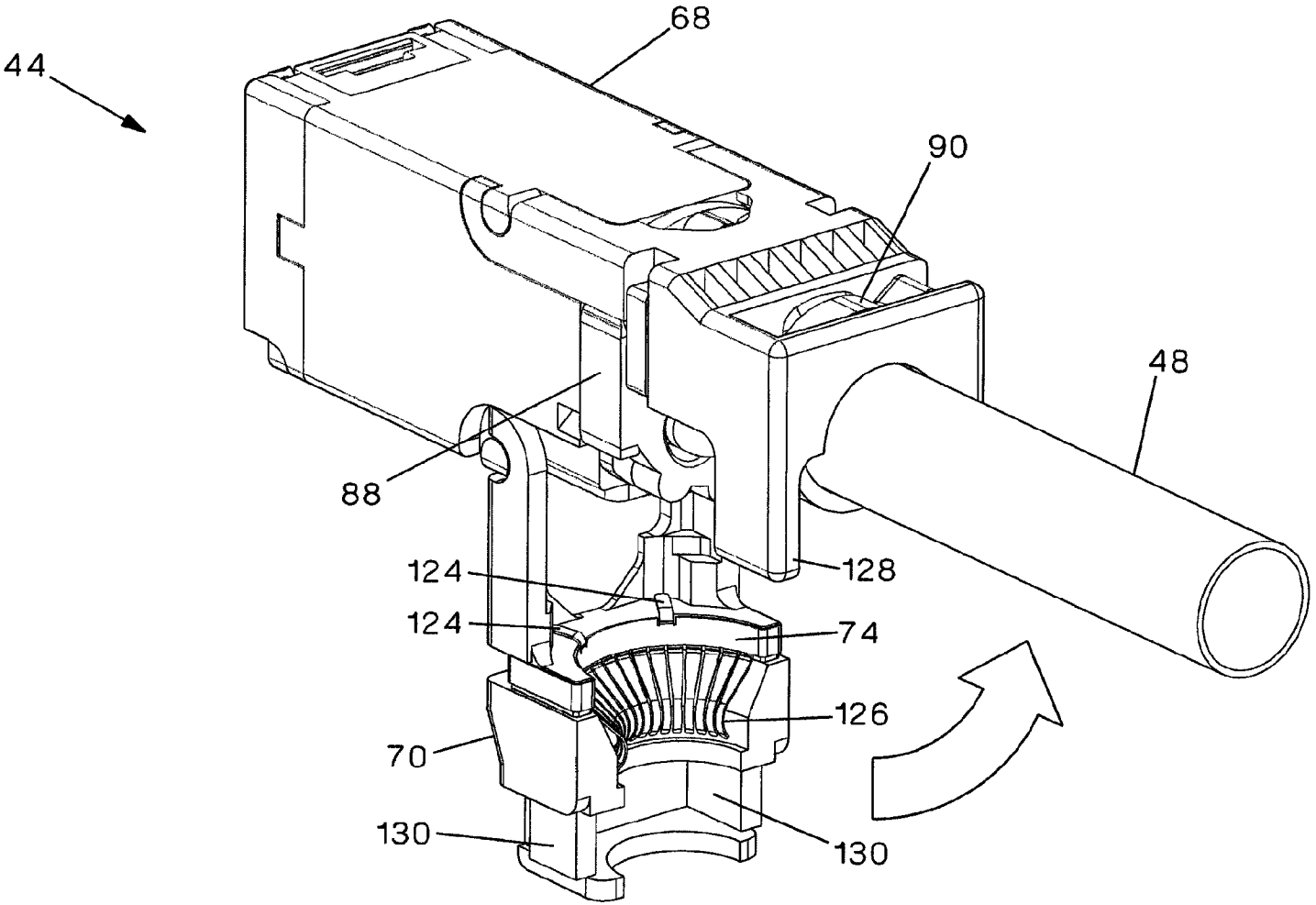
FIG. 17 shows a rear isometric view of a partially assembled jack with a lower latching arm in an open position according to an embodiment of the present invention.
Figure 18:
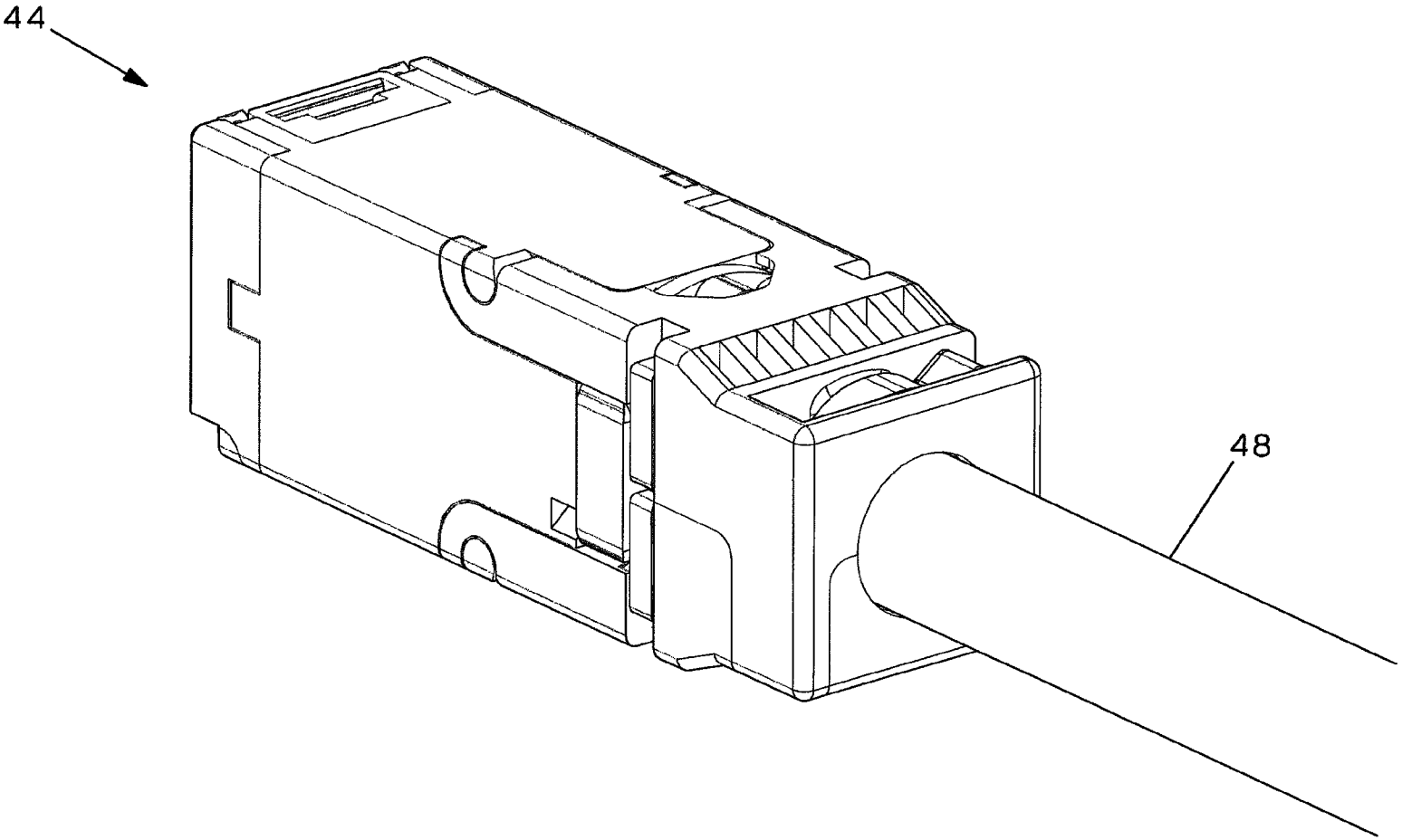
FIG. 18 shows a rear isometric view of an assembled jack according to an embodiment of the present invention.

With wire cap 92 rotated into position, upper latch arm 72, with braid bonding contact 74 assembled thereto, hingedly connects to the upper portion of the housing 68 and rotates downward, as shown in FIG. 15A, over the top half of S/FTP cable 48. Braid bonding contact 74 includes two short flanges 124 and a plurality of long flanges 126. Short flanges 124 bond to metal wire cap nut 88 and long flanges 126 electrically bond to braid 98 of S/FTP cable 48 when upper latch arm 72 is rotated into its closed downward position, as shown in FIG. 15B. In this embodiment, upper latch arm 72 is not able to reach its final rotated position unless wire cap 92 is properly oriented. After upper latch arm 72 is fully rotated, cable tie 90 can be used to secure S/FTP cable to upper latch arm 72, as shown in FIG. 16. This configuration can provide strain relief such that forces exerted on S/FTP cable 48 are generally distributed through cable tie 90 and not through the interface between wires 108 and IDCs 80. Finally, lower latch arm 70, with braid bonding contact 74 assembled thereto, hingedly connects to the bottom portion of the housing 68 and rotates upward, as shown in FIG. 17, to meet the bottom half of S/FTP cable 48. Similar to positioning upper latch arm 72, short flanges 124 bond to metal wire cap nut 88 and long flanges 126 electrically bond to braid 98 of S/FTP cable 48 when lower latch arm 70 is rotated into its closed upward position. Upper latch arm 72 includes two latches 128 that engage latch-receiving features 130 located on lower latch arm 70. Rotating latch arms 70 and 72 into their closed positions causes latches 128 to engage latch receiving features 130 and keep the latch arm assembly together, preventing wire cap 92 from inadvertently rotating out of position. FIG. 18 shows a complete assembly of S/FTP cable 48 terminated to jack 44 according to one embodiment of the present invention.

Figure 19:
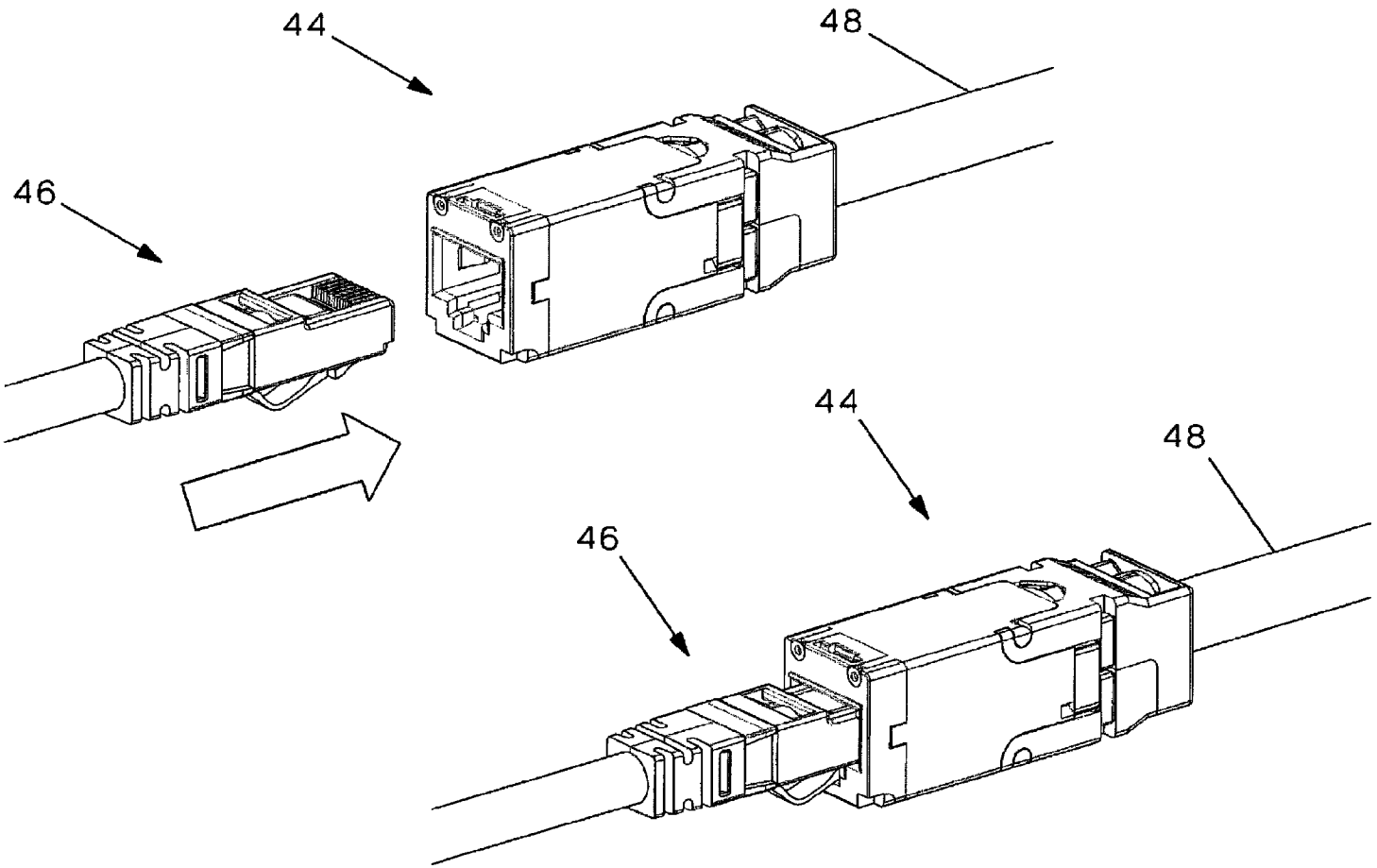
FIG. 19 shows an RJ45 plug mating with a jack according to an embodiment of the present invention.
Figure 20:
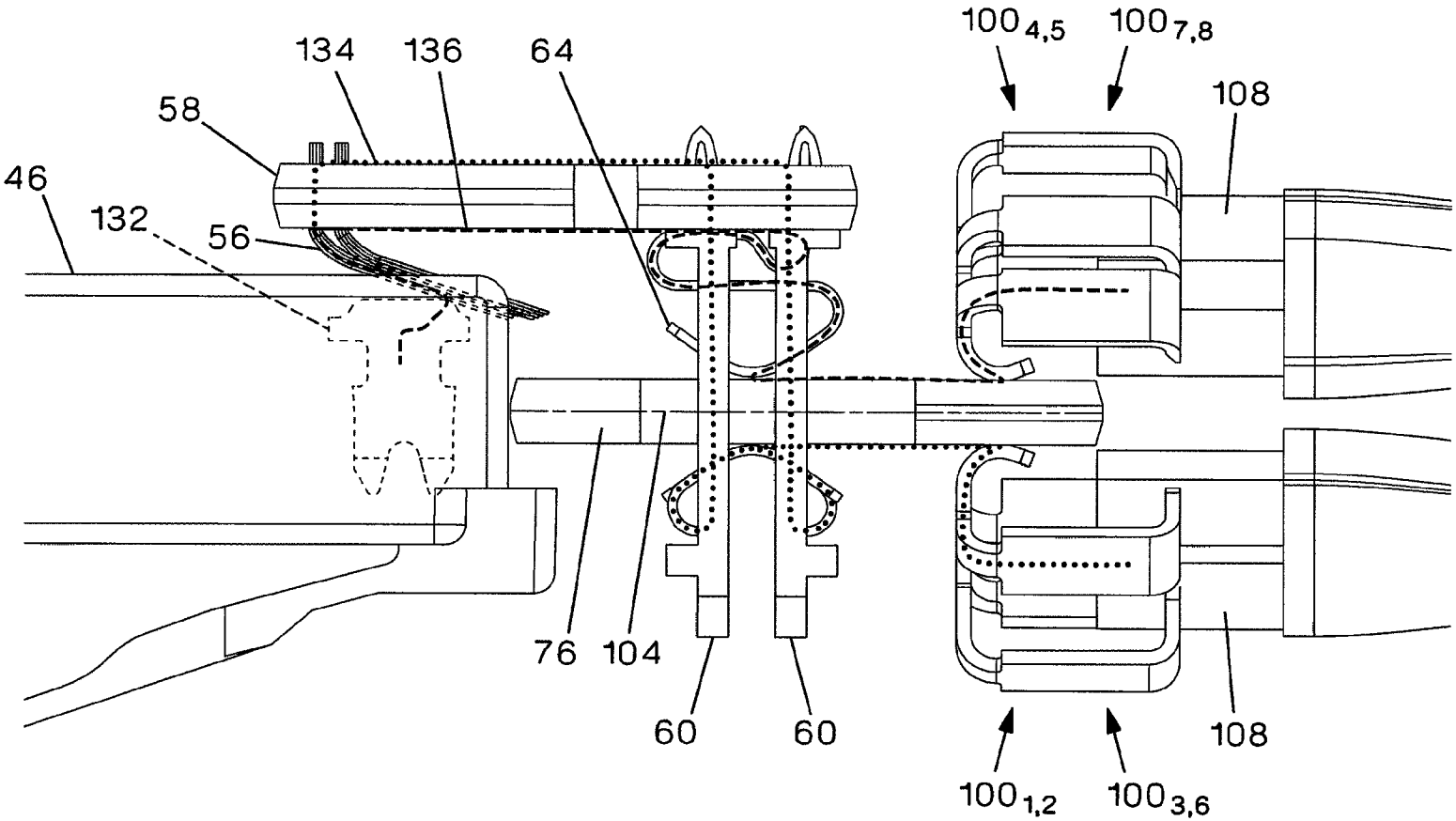
FIG. 20 shows a side cross-sectional view of an RJ45 plug mated to a jack according to an embodiment of the present invention.
Figure 21:
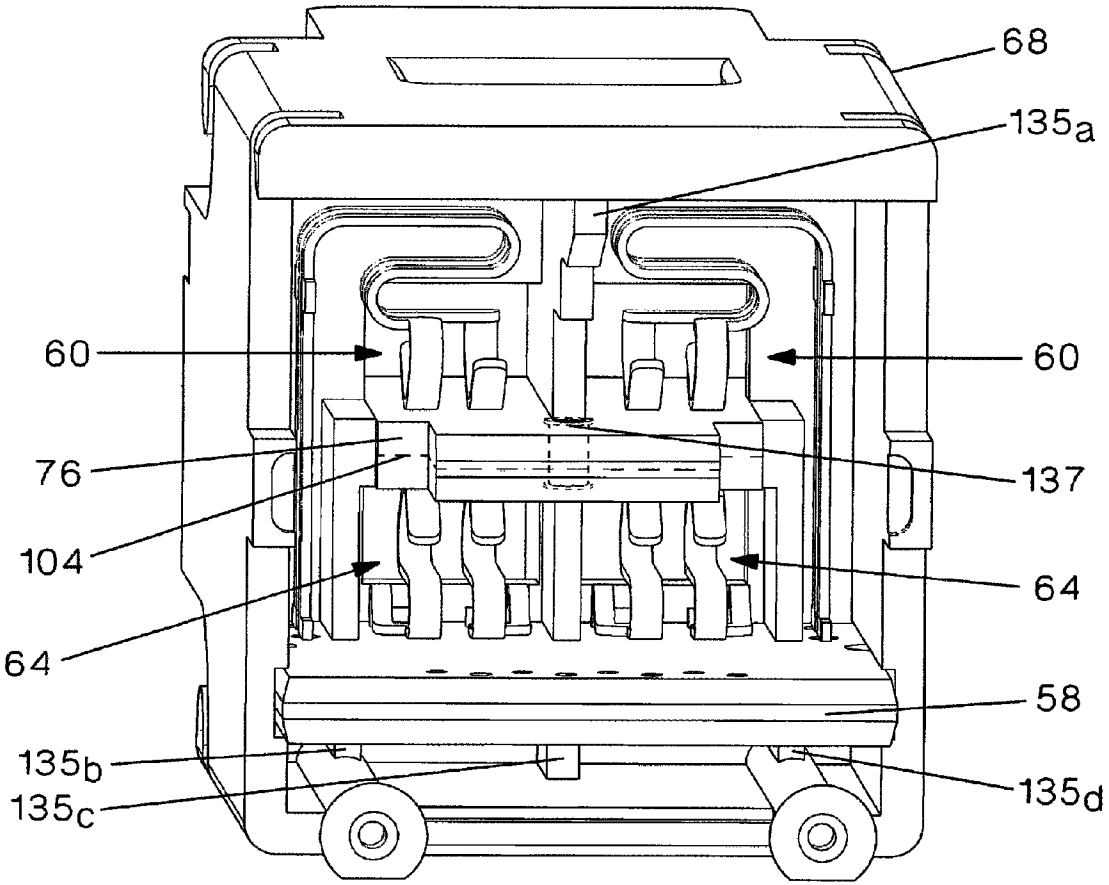
FIG. 21 shows a front isometric view of a rear section of a jack according to an embodiment of the present invention.

FIG. 19 shows an embodiment of the present invention where jack 44 is compatible with an RJ45 plug 46 for applications that require Enhanced Category 5 (CAT5E), Category 6 (CAT6), Augmented Category 6 (CAT6A), or similar connectivity. FIG. 20 shows a side view of an RJ45 plug 46 mated to jack 44 from FIG. 19. For clarity, generally all non-current-carrying components of jack 44 have been removed in order to illustrate the signal transmission paths. For pins 1, 2, 3, and 6 of the RJ45 plug 46, as defined by ANSI/TIA-568-C.2, the data flow is represented by signal transmission path 134 illustrated by a dotted line. If it is assumed that the data-carrying signal begins in the RJ45 plug 46, then the current corresponding to that signal flows from plug contacts 132 through plug interface contacts (PICs) 56. From PICs 56, current enters the first PCB 58. Within the first PCB 58, crosstalk effects can be reduced by employing compensation techniques. Current then travels from first PCB 58 through tall PCB-to-PCB contacts 60 and reaches main PCB 76. Main PCB 76 includes traces that bring current to IDC pairs $\mathbf{100}_{1,2}$ and $\mathbf{100}_{3,6}$, wherein IDCS $\mathbf{100}_1$, $\mathbf{100}_2$, $\mathbf{100}_3$, and $\mathbf{100}_6$ correspond to pins 1, 2, 3, and 6 of the RJ45 plug 46, respectively. From IDC pairs $\mathbf{100}_{1,2}$ and $\mathbf{100}_{3,6}$, current travels through wires 108, completing the electrical connection. For pins 4, 5, 7, and 8 of the RJ45 plug 46, as defined by ANSI/TIA-568-C.2, the data flow is represented by signal transmission path 136 illustrated as a dashed line. Current flows from plug contacts 132 through PICs 56. From PICs 56, current enters the first PCB 58, where crosstalk effects can be reduced by employing compensation techniques. Current then travels from first PCB 58 through short PCB-to-PCB contacts 64 and reaches main PCB 76. Main PCB 76 includes traces that bring the current to IDC pairs $\mathbf{100}_{4,5}$ and $\mathbf{100}_{7,8}$ wherein IDCS $\mathbf{100}_4$, $\mathbf{100}_5$, $\mathbf{100}_7$, and $\mathbf{100}_8$ correspond to pins 4, 5, 7, and 8 of the RJ45 plug 46, respectively. From IDC pairs $\mathbf{100}_{4,5}$ and $\mathbf{100}_{7,8}$, current travels through wires 108, completing the electrical connection. As shown in FIG. 21, (front view of jack 44 with metal front face 52, PICs 56, contact support structures 62 and 66, grounding tabs 54, and latch arms 70 and 72 removed) ground plane 104 may reduce crosstalk effects through the main PCB 76, and shielding walls $\mathbf{135}_a$-$\mathbf{135}_d$, which are designed into the housing 68 and can be made of metal, may reduce crosstalk among PCB-to-PCB contacts 60, 64. An embodiment of a jack having such a configuration may achieve CAT6A performance requirements. In one embodiment, grounding plane 104 can be bonded to metal housing 68 through a solder joint to a plated-through hole via 137 of main PCB 76.

Figures 22A, 22B:
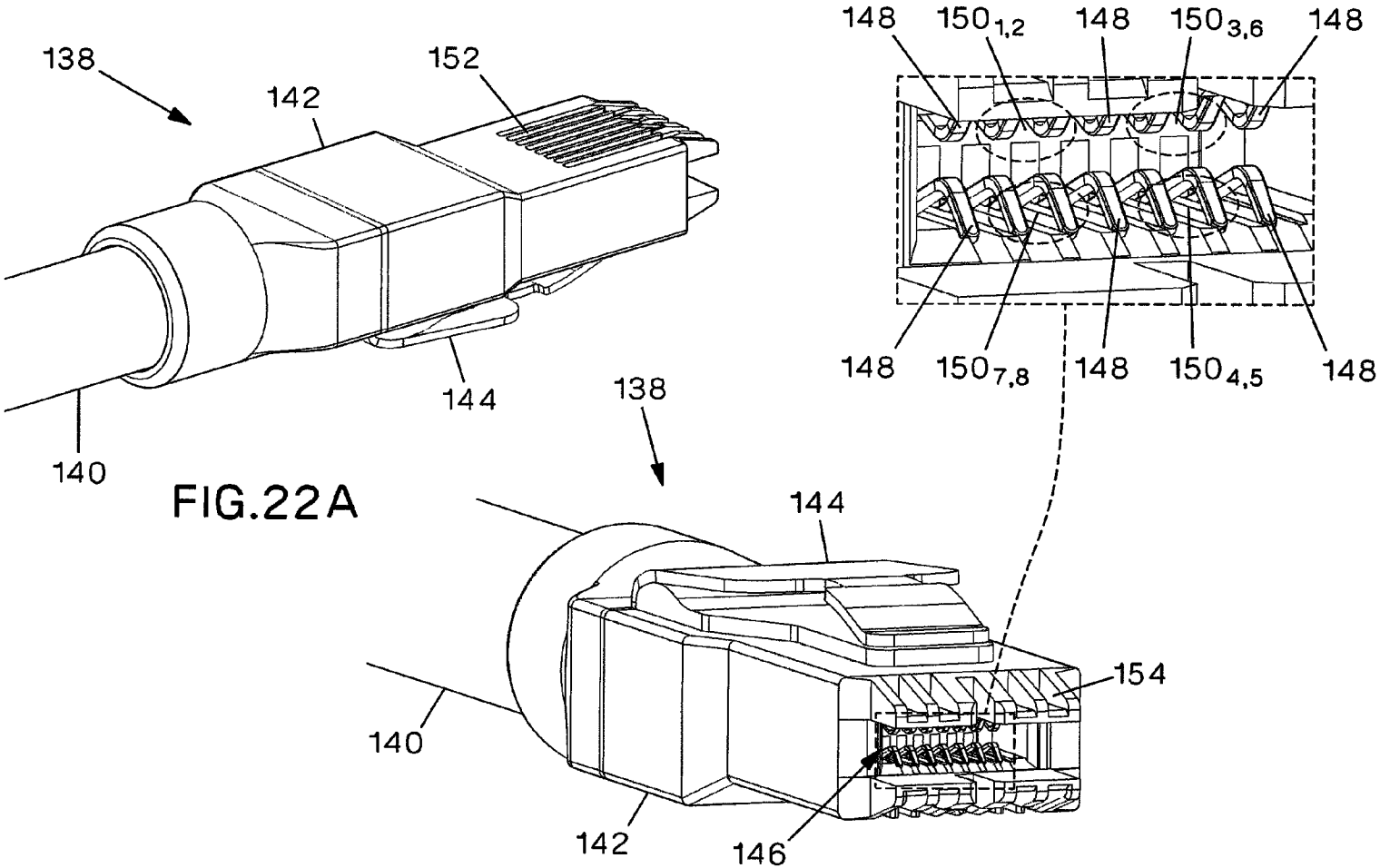
FIG. 22A shows a rear isometric view of a plug according to an embodiment of the present invention.
FIG. 22B shows a front isometric view of the plug of FIG. 22A.

Jack 44 is also compatible with other applications, which may have higher data rates than those currently established for the RJ45 interface. For such applications, a new style of plug is used. For discussion purposes, this new style of plug is referred to as high bandwidth plug 138. One embodiment of the high bandwidth plug 138 is shown in FIGS. 22A and 22B. In this embodiment the high bandwidth plug 138 terminates to S/FTP network cable 140. The outer profile of high bandwidth plug is defined by a metal plug housing 142. Sheet metal latch 144 locks high bandwidth plug 138 to jack 44 in a similar style as RJ45 plug 46. High bandwidth plug 138 does not use plug contacts 132 like RJ45 plug 46. Instead, a PCB edge connector 146 is used to make the electrical connection between high bandwidth plug 138 and jack 44. In one embodiment, the PCB edge connector 146 includes 14 contacts, six of which are ground contacts 148 and eight of which are signal pair contacts 150. Network cable 140 includes four twisted pairs of wires. Each wire pair is terminated such that they make electrical connections to respective signal pair contacts $\mathbf{150}_{1,2}$, $\mathbf{150}_{3,6}$, $\mathbf{150}_{4,5}$, and $\mathbf{150}_{7,8}$. To improve balance and electrical performance, it is advantageous to locate signal pair contacts 150 between ground contacts 148 as shown in the detail view of FIG. 22B.

Figure 23:
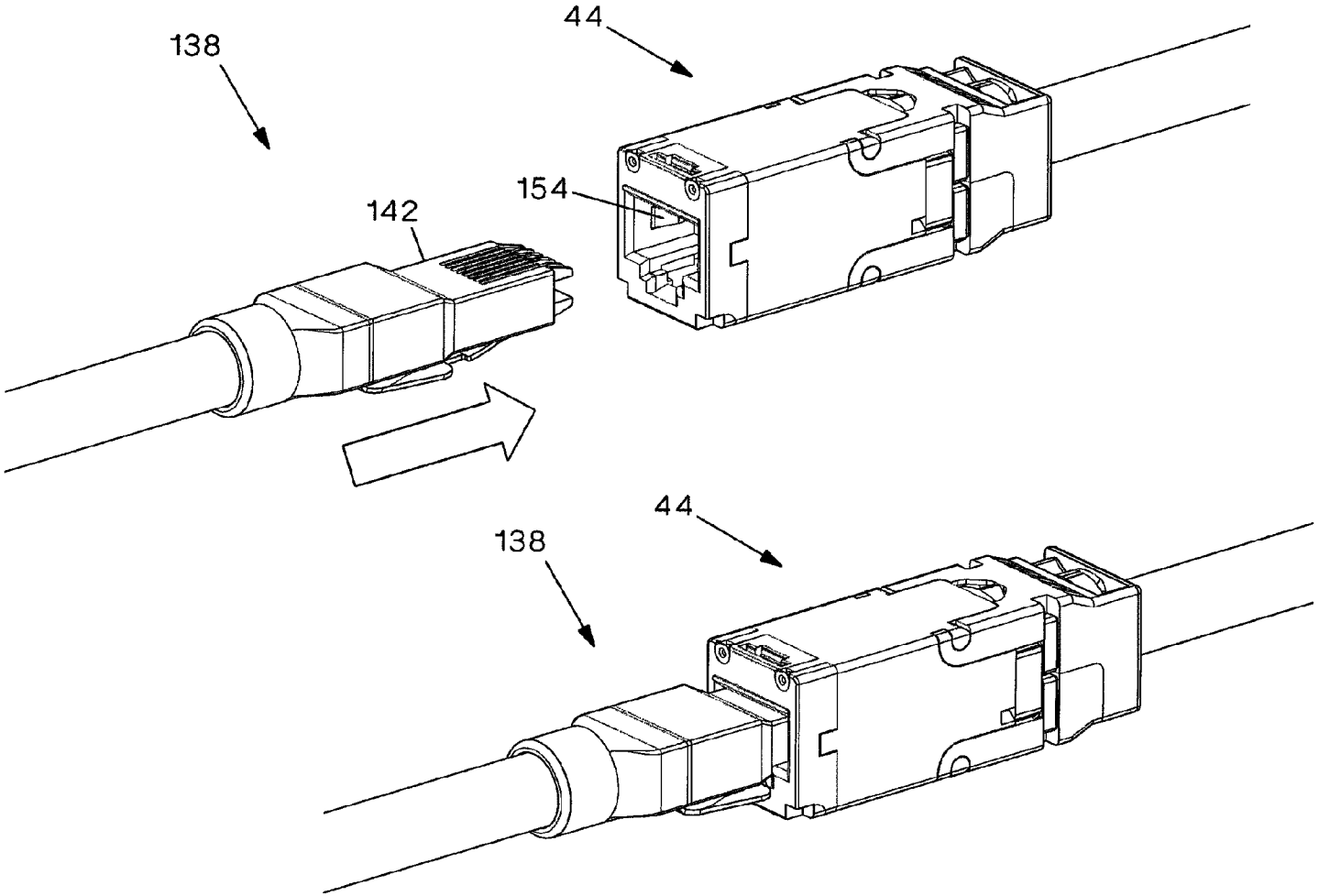
FIG. 23 shows the plug of FIG. 22A mating with a jack according to an embodiment of the present invention.
Figure 24:
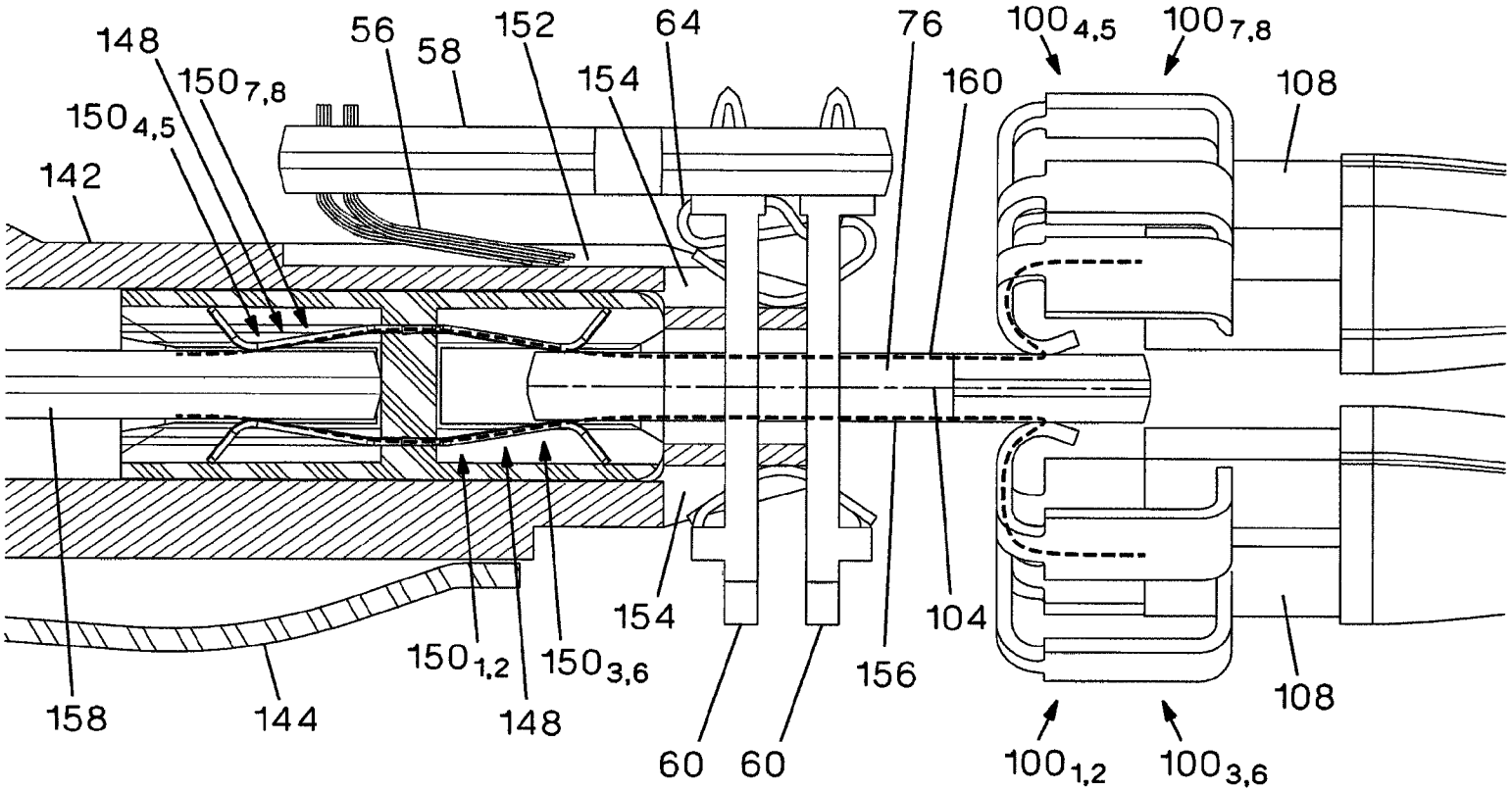
FIG. 24 shows a side cross-sectional view of the plug of FIG. 22A mated to a jack according to an embodiment of the present invention.

In an embodiment of the present invention, high bandwidth plug 138 connects to jack 44 as shown in FIG. 23. Plug grounding tabs 54 electrically bond to metal plug housing 142 to create continuous grounding from high bandwidth plug 138 to jack 44. FIG. 24 shows a side view of high bandwidth plug 138 mated to jack 44 from FIG. 23. For clarity, generally all non-current-carrying components of jack 44 have been removed in order to illustrate the signal transmission paths. Metal plug housing 142 includes PIC slots 152 and PCB-to-PCB contact slots 154 (reference FIGS. 22A and 22B). When high-bandwidth plug 138 is inserted into jack 44, PICs 56 are depressed and held within their respective PIC slots 152, making an electrical bond to the grounded metal plug housing 142. Metal plug housing 142 is grounded via plug grounding tabs 54 shown in FIG. 3. Similarly, tall PCB-to-PCB contacts 60 and short PCB-to-PCB contacts 64 are displaced and constrained within their respective PCB-to-PCB contact slots 154. The displacement of PCB-to-PCB contacts 60 and 64 causes them to lose electrical connection to main PCB 76 and connects them to ground. For signal pair contacts $\mathbf{150}_{1,2}$ and $\mathbf{150}_{3,6}$ the data flow is represented by signal transmission path 156 illustrated by a dotted line. If it is assumed that the data-carrying signal begins in plug PCB 158, the signal propagates from plug PCB 158 through signal pair contacts $\mathbf{150}_{1,2}$ and $\mathbf{150}_{3,6}$. Main PCB 76 includes contact pads that interface with signal pair contacts $\mathbf{150}_{1,2}$ and $\mathbf{150}_{3,6}$, and ground contacts 148. Current flows from signal pair contacts $\mathbf{150}_{1,2}$ and $\mathbf{150}_{3,6}$ through the contact pads and onto main PCB 76. From there, current flows along the traces on main PCB 76 to respective IDC pairs $\mathbf{100}_{1,2}$ and $\mathbf{100}_{3,6}$ (wherein IDC pairs $\mathbf{100}_{1,2}$ and $\mathbf{100}_{3,6}$ correspond to signal pair contacts $\mathbf{150}_{1,2}$ and $\mathbf{150}_{3,6}$, respectively), and through to wires 108 of an S/FTP cable. Similarly, for signal pair contacts $\mathbf{150}_{4,5}$ and $\mathbf{150}_{7,8}$ the data flow is represented by signal transmission path 160 illustrated by a dotted line. Current flows from plug PCB 158 through signal pair contacts $\mathbf{150}_{4,5}$ and $\mathbf{150}_{7,8}$ and onto main PCB 76 via the contact pads. From there, current flows along the traces on main PCB 76 to respective IDC pairs $\mathbf{100}_{4,5}$ and $\mathbf{100}_{7,8}$ (wherein IDC pairs $\mathbf{100}_{4,5}$ and $\mathbf{100}_{7,8}$ correspond to signal pair contacts $\mathbf{150}_{4,5}$ and $\mathbf{150}_{7,8}$, respectively), and through to wires 108 of an S/FTP cable, completing the electrical connection. Crosstalk among transmission pairs can be reduced by the ground plane 104 in main PCB 76 as well as wall features designed into the housing 68, which can allow for higher bandwidth and higher transmission speeds.

One advantage of the at least one embodiment of the present invention is a connector with at least some of the RJ45 connectivity elements isolated from the new higher bandwidth connectivity while the new higher bandwidth connectivity is used. Another advantage of the at least one embodiment of the present invention is a new connectivity form factor that is capable of meeting the new high bandwidth requirement in all aspects of data signaling. Another advantage of the at least one embodiment of the present invention is a new termination method for the shielded twisted pair cabling that provides low crosstalk and signal reflection.

It should be noted that while this invention has been described in terms of one or more embodiments, these embodiments are non-limiting, and there are alterations, permutations, and equivalents that fall within the scope of this invention. It should also be noted that there are many alternative ways of implementing the methods and apparatuses of the present invention. It is therefore intended that claims that may follow be interpreted as including all such alterations, permutations, and equivalents as fall within the true spirit and scope of the present invention.

We claim:

1. A communication connector comprising:

a housing having a communication port, said communication port defining a cavity for alternately receiving a first type of a plug and a second type of a plug, said first type of a plug being different from said second type of a plug;

a first printed circuit board (PCB) positioned at least partially within said housing, said first PCB having a plurality of plug interface contacts (PICs) extending from said first PCB at least partially into said cavity for making contact with a plurality of plug contacts of said first type of a plug;

a second PCB positioned at least partially within said housing, said second PCB having a plurality of contact pads positioned at least partially within said cavity for making contact with a plurality of plug contacts of said second type of a plug; and a plurality of insulation displacement contacts (IDCs) contacting said second PCB.

2. The communication connector of claim 1, wherein said first PCB includes a plurality of first PCB conductive traces in electrical contact with said plurality of PICs, said second PCB includes a plurality of second PCB conductive traces in electrical contact with said plurality of contact pads and said IDCs, an electrical contact existing between said plurality of first PCB conductive traces and said plurality of second PCB conductive traces when said first type of a plug is received within said housing.

3. The communication connector of claim 2, wherein said electrical contact between said plurality of first PCB conductive traces and said plurality of second PCB conductive traces occurs via a plurality of PCB-to-PCB contacts.

4. The communication connector of claim 3, wherein said electrical contact between said plurality of first PCB conductive traces and said plurality of second PCB conductive traces is terminated when said second type of a plug is received within said housing.

5. The communication connector of claim 4, wherein said termination of said electrical contact between said plurality of first PCB conductive traces and said plurality of second PCB conductive traces occurs via a displacement of at least a portion of said plurality of PCB-to-PCB contacts.

6. The communication connector of claim 3, wherein said plurality of PCB-to-PCB contacts are constrained within a plurality of support structures.

7. The communication connector of claim 1, wherein said housing includes at least one generally vertical wall feature, said second PCB being positioned generally horizontally with respect to said at least one generally vertical wall feature, said at least one generally vertical wall feature and said second PCB defining four quadrants, and said plurality of IDCs including four pairs of IDCs, wherein each of said pairs of IDCs is positioned within each of said quadrants, respectively.

8. The communication connector of claim 7, wherein at least one of said at least one generally vertical wall feature and said second PCB provide at least some electrical shielding.

9. The communication connector of claim 8, wherein said at least some electrical shielding reduces crosstalk between any one of said pairs of IDCs and any other of said pairs of IDCs.

10. The communication connector of claim 1, wherein said housing is metal.

11. The communication connector of claim 1 further comprising a wire cap, said wire cap including at least one conductor alignment structure, an isolation component, a plurality of grounding springs, and a wire cap nut, said wire cap being attached at a rear end of said housing.

12. The communication connector of claim 11, wherein said wire cap is rotateably attached to said rear end of said housing.

13. The communication connector of claim 11 further comprising a first latch arm and a second latch arm, said first latch arm and said second latch arm each being attached to said housing and having an open position and a closed position.

14. The communication connector of claim 13 further comprising a cable tie, said cable tie securing said first latch arm to a communication cable.

15. The communication connector of claim 13, wherein movement of said wire cap is restricted when at least one of said first latch arm and said second latch arm is in said closed position.

16. The communication connector of claim 13, wherein at least one of said first latch arm and said second latch arm is hingedly attached to said housing.

17. The communication connector of claim 1, wherein said first type of a plug is an RJ45 plug.

18. A communication connector comprising:

a housing defining a cavity for receiving a communication plug, said housing includes at least one generally vertical wall feature;

a first PCB positioned at least partially within said housing, said first PCB used for making electrical contact with a first type of a plug;

a second PCB positioned at least partially within said housing, said second PCB used for making electrical contact with a second type of a plug, said second PCB positioned generally horizontally with respect to said at least one generally vertical wall feature, said at least one generally vertical wall feature and said second PCB defining four housing quadrants, each of said housing quadrants being at least partially electrically shielded from any other housing quadrant; and a plurality of IDCs contacting said second PCB, said plurality of IDCs arranged in multiple pairs, each of said multiple pairs positioned in a respective housing quadrant.

19. The communication connector of claim 18 further comprising a wire cap attached at a rear end of said housing, said wire cap including an isolation component, said isolation component defining four isolation component quadrants, each of said isolation component quadrants being at least partially electrically shielded from any other isolation component quadrant, wherein said wire cap and said housing alight such that said four housing quadrants align with said four isolation component quadrants.

20. The communication connector of claim 19 further comprising a first latch arm and a second latch arm, said first latch arm and said second latch arm each being attached to said housing and having an open position and a closed position.

* * * * *